US007367144B2

(12) United States Patent
Jones et al.

(10) Patent No.: US 7,367,144 B2
(45) Date of Patent: May 6, 2008

(54) WEAR MEMBER FOR EXCAVATING EQUIPMENT

(75) Inventors: Larren F. Jones, Portland, OR (US); Christopher M. Carpenter, Tualatin, OR (US); David M. Graf, Scappoose, OR (US)

(73) Assignee: ESCO Corporation, Portland, OR (US)

( * ) Notice: Subject to any disclaimer, the term of this patent is extended or adjusted under 35 U.S.C. 154(b) by 22 days.

(21) Appl. No.: 11/324,944

(22) Filed: Jan. 4, 2006

(65) Prior Publication Data

US 2006/0117613 A1 Jun. 8, 2006

Related U.S. Application Data

(60) Division of application No. 10/187,446, filed on Jul. 2, 2002, now Pat. No. 6,993,861, which is a continuation-in-part of application No. 09/899,535, filed on Jul. 6, 2001, now Pat. No. 6,735,890.

(60) Provisional application No. 60/369,846, filed on Apr. 5, 2002.

(51) Int. Cl.

| | |
|---|---|
| ***A01B 15/00*** | (2006.01) |
| ***A01B 15/10*** | (2006.01) |
| ***A01B 23/00*** | (2006.01) |
| ***A01B 31/00*** | (2006.01) |
| ***E02F 9/28*** | (2006.01) |

(52) U.S. Cl. ..... 37/456; 172/772.5

(58) Field of Classification Search ..... 37/452, 37/455–459; 172/772, 772.5

See application file for complete search history.

(56) References Cited

U.S. PATENT DOCUMENTS

| | | | |
|---|---|---|---|
| 821,215 | A | 5/1906 | Cantlebery et al. |
| 1,729,889 | A | 10/1929 | McNinch |
| 2,032,875 | A | 3/1936 | Graham |
| 2,040,085 | A | 5/1936 | Fykse et al. |
| 2,145,663 | A | 1/1939 | Reynolds |
| 2,419,677 | A | 4/1947 | Daniels et al. |
| 2,483,032 | A | 9/1949 | Baer |
| 2,846,790 | A | 8/1958 | Davis et al. |
| 2,896,345 | A | 7/1959 | Peklay |
| 3,082,555 | A | 3/1963 | Hill |
| 3,117,386 | A | 1/1964 | Ferwerda |
| 3,413,740 | A | 12/1968 | Peterson |
| 3,453,756 | A | 7/1969 | Schroeder |
| 3,496,656 | A | 2/1970 | Eyolfson |
| 3,722,932 | A | 3/1973 | Dougall |
| 4,103,442 | A | 8/1978 | Zepf |
| 4,136,469 | A | 1/1979 | Zepf |

(Continued)

FOREIGN PATENT DOCUMENTS

| | | |
|---|---|---|
| DE | 2162474 | 12/1971 |

(Continued)

*Primary Examiner*—Christopher J. Novosad
(74) *Attorney, Agent, or Firm*—Steven P. Schad

(57) ABSTRACT

A wear assembly provided with a tapered opening and a complementary tapered lock wherein the lock can be pried into and from the opening to thereby eliminate the need for hammering. The lock is formed with a body and a latch that is movable between a hold position where the latch is engageable with a stop in the opening to releaseably retain the lock in the opening and a release position where the latch disengages the stop.

37 Claims, 28 Drawing Sheets

U.S. PATENT DOCUMENTS

| | | | | | |
|---|---|---|---|---|---|
| 4,282,665 | A | | 8/1981 | Fletcher et al. | |
| 4,326,348 | A | | 4/1982 | Emrich | |
| 4,335,532 | A | | 6/1982 | Hahn et al. | |
| 4,391,050 | A | | 7/1983 | Smith et al. | |
| 4,404,760 | A | | 9/1983 | Hahn et al. | |
| 4,470,210 | A | | 9/1984 | Hahn | |
| 4,481,728 | A | | 11/1984 | Mulder et al. | |
| 4,577,423 | A | | 3/1986 | Hahn | |
| 4,761,900 | A | | 8/1988 | Emrich | |
| 4,811,505 | A | | 3/1989 | Emrich | |
| 4,965,945 | A | | 10/1990 | Emrich | |
| 5,018,283 | A | | 5/1991 | Fellner | |
| 5,052,134 | A | | 10/1991 | Bierwith | |
| 5,068,986 | A | * | 12/1991 | Jones | 37/457 |
| 5,074,062 | A | | 12/1991 | Hahn et al. | |
| 5,148,616 | A | | 9/1992 | Maguina-Larco | |
| 5,152,087 | A | | 10/1992 | Maguina-Larco | |
| 5,152,088 | A | | 10/1992 | Hahn | |
| 5,177,886 | A | | 1/1993 | Klett | |
| 5,233,770 | A | | 8/1993 | Robinson | |
| 5,311,681 | A | | 5/1994 | Ruvang et al. | |
| 5,325,615 | A | | 7/1994 | Hutchins et al. | |
| 5,331,754 | A | | 7/1994 | Ruvang | |
| 5,361,520 | A | | 11/1994 | Robinson | |
| 5,410,826 | A | | 5/1995 | Immel et al. | |
| 5,465,512 | A | | 11/1995 | Livesay et al. | |
| 5,469,648 | A | | 11/1995 | Jones et al. | |
| 5,491,915 | A | | 2/1996 | Robinson | |
| 5,561,925 | A | * | 10/1996 | Livesay | 37/455 |
| 5,564,206 | A | | 10/1996 | Ruvang | |
| 5,638,621 | A | | 6/1997 | Keech et al. | |
| 5,709,043 | A | | 1/1998 | Jones et al. | |
| 5,718,070 | A | | 2/1998 | Ruvang | |
| 5,784,813 | A | | 7/1998 | Balassa et al. | |
| 5,802,752 | A | | 9/1998 | Quarfordt | |
| 5,868,518 | A | | 2/1999 | Chesterfield et al. | |
| 5,918,391 | A | | 7/1999 | Vinas Peya | |
| 6,030,143 | A | | 2/2000 | Kreitzberk | |
| 6,047,487 | A | | 4/2000 | Clendenning | |
| 6,108,950 | A | | 8/2000 | Ruvang et al. | |
| 6,145,224 | A | * | 11/2000 | Stickling | 37/458 |
| 6,158,917 | A | | 12/2000 | Wolin et al. | |
| 6,301,810 | B1 | | 10/2001 | Fidler | |

FOREIGN PATENT DOCUMENTS

| | | |
|---|---|---|
| EP | 1048782 | 11/2000 |
| GB | 2 116 616 A | 9/1983 |
| SE | 469561 | 7/1993 |

* cited by examiner

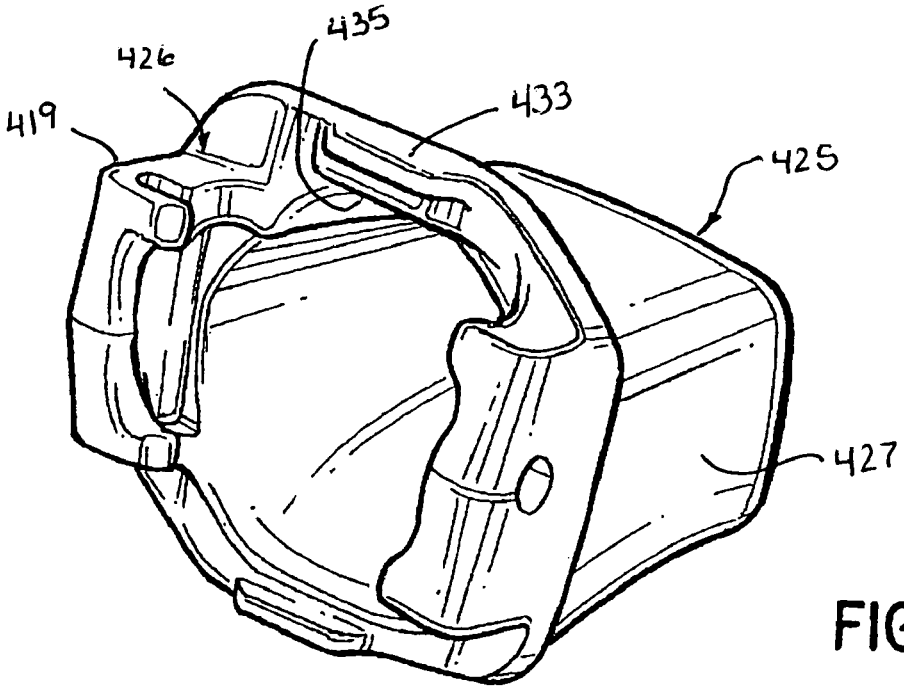
FIG. 42
FIG. 43
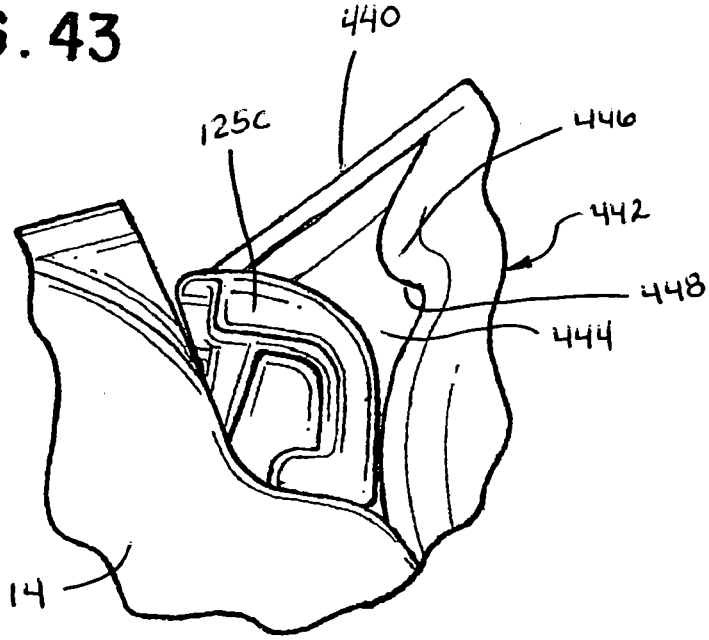

WEAR MEMBER FOR EXCAVATING EQUIPMENT

This application is a divisional application of U.S. patent application Ser. No. 10/187,446, filed Jul. 2, 2002 now U.S. Pat. No. 6,993,861, which is a continuation-in-part of U.S. provisional application Ser. No. 60/369,846, filed Apr. 5, 2002, and U.S. patent application Ser. No. 09/899,535, filed Jul. 6, 2001, now U.S. Pat. No. 6,735,890.

FIELD OF THE INVENTION

The present invention pertains to a novel construction for attaching a wear part to an excavator or the like.

BACKGROUND AND SUMMARY OF THE INVENTION

The invention in this application is at times described in relative terms, such as "up" and "down," for ease of explanation. These terms generally are to be understood in relation to the orientation of the wear assembly as illustrated in FIG. 1. However, the wear assembly can be placed in all kinds of orientations, and the relative terms used to describe the invention are not intended to be a limitation of the invention.

Wear parts, such as teeth and shrouds, have long been secured along the digging edges of various excavators (e.g., the front lip of a bucket for a front end loader) to break up the earthen material to be collected and to protect the digging edge from premature wear. To facilitate replacement of the wear parts and reduce the amount of material needing frequent replacement, the wear parts are typically composed of multiple parts. As an example, the wear parts may include an adapter, a wear point or tip, and a lock to removably secure the wear member to the adapter.

An adapter is a base that is fixed to the digging edge of an excavator by welding, mechanical attachment or being cast as an integral portion of the bucket lip. The adapter itself may have multiple parts, particularly in larger sized teeth, but is commonly a single component. In any event, the adapter includes a forwardly projecting nose shaped to securely hold the wear member in place. In an excavating tooth, the wear member is a point or tip that has a generally wedge-shaped configuration with top and bottom walls that converge to a digging edge. The base end of the point includes a rearwardly opening socket to receive the adapter nose. The lock, typically in the form of a pin, is inserted into a passage formed by an opening in the adapter nose that aligns with openings in opposite walls of the point. The passage may extend through a central portion of the nose either vertically or horizontally, or be defined externally of the nose to receive an external lock, for example, as disclosed in U.S. Pat. No. 4,965,945, which is hereby incorporated by reference.

Although the passage receiving the lock may be linear or curved, the sides of the lock and the walls of the passage receiving the lock have in the past been defined by generally parallel surfaces. As a result, the sides of the lock slide against the walls of the passage in face-to-face contact as the lock is being inserted into or removed from the tooth. Moreover, it is important to maintain the lock in the defined passage so that the point is not lost. Loss of the point not only leads to premature wearing of the adapter, but may also damage downstream machinery intended to process the excavated material. Accordingly, the lock is fit tightly within the defined passage to inhibit its ejection or loss. As can be appreciated, this sliding action of the lock generates significant frictional resistance. In the past, a large hammer has been needed to force the lock into and out of the passage. This tends to be an onerous and time-consuming task for the operator in the field.

The present invention solves the difficulties of inserting and removing the lock via a novel construction that enables the lock to be inserted into and removed out of the wear assembly (e.g., a tooth) without the need for repeated hammer blows. More specifically, a tapered lock is received within a complementary opening whereby the lock can be inserted and removed by a prying tool. The use of such a cooperative lock and opening can be used to secure different types of wear members (e.g., points and shrouds) usable in excavating operations.

In one aspect of the invention, the wear assembly has a tapered opening that is adapted to receive a complementary shaped lock. In one construction, the opening is tapered such that the front and rear walls converge as they extend away from the opening's inlet end. In a preferred embodiment, the opening narrows in generally three perpendicular directions. The opening also preferably includes a stop to releaseably retain the lock in the opening and a notch to better help prevent twisting of the lock under load.

In another aspect of the invention, the lock includes a body that generally converges toward one end to define a tapered configuration. Due to the tapered shape of the lock, as opposed to a lock with generally parallel sidewalls, the lock does not slide in face-to-face contact with the sidewalls of the passage and generate high frictional resistance as it is being placed into and out of the passage. Accordingly, the lock can be pried into and out of the passage without the use of a hammer. In a preferred aspect of the invention, the prying tool is a member that rotates to release the latch of the lock and to pull the lock from the opening.

In one preferred embodiment of the invention, the wear member (e.g., a point) has an ear that projects rearwardly from the socket defined to receive the adapter nose. The ear includes a tapered slot or opening to receive and support the tapered lock when fully inserted, but without the frictional sliding against the sides of the slot when only partially fit into the slot. The full face-to-face engagement between the lock and the slot only occurs when the lock has been fully inserted. The lock has a latch that cooperates with a formation in the tooth to hold the lock in place during use of the tooth.

BRIEF DESCRIPTION OF THE DRAWINGS

FIG. 42 is a rear perspective view of another embodiment of a wear member in accordance with the present invention.

FIG. 43 is a partial side view of a wear assembly with a lock, fit between the wear member and the adapter.

DETAILED DESCRIPTION OF THE PREFERRED EMBODIMENTS

Figure 1:
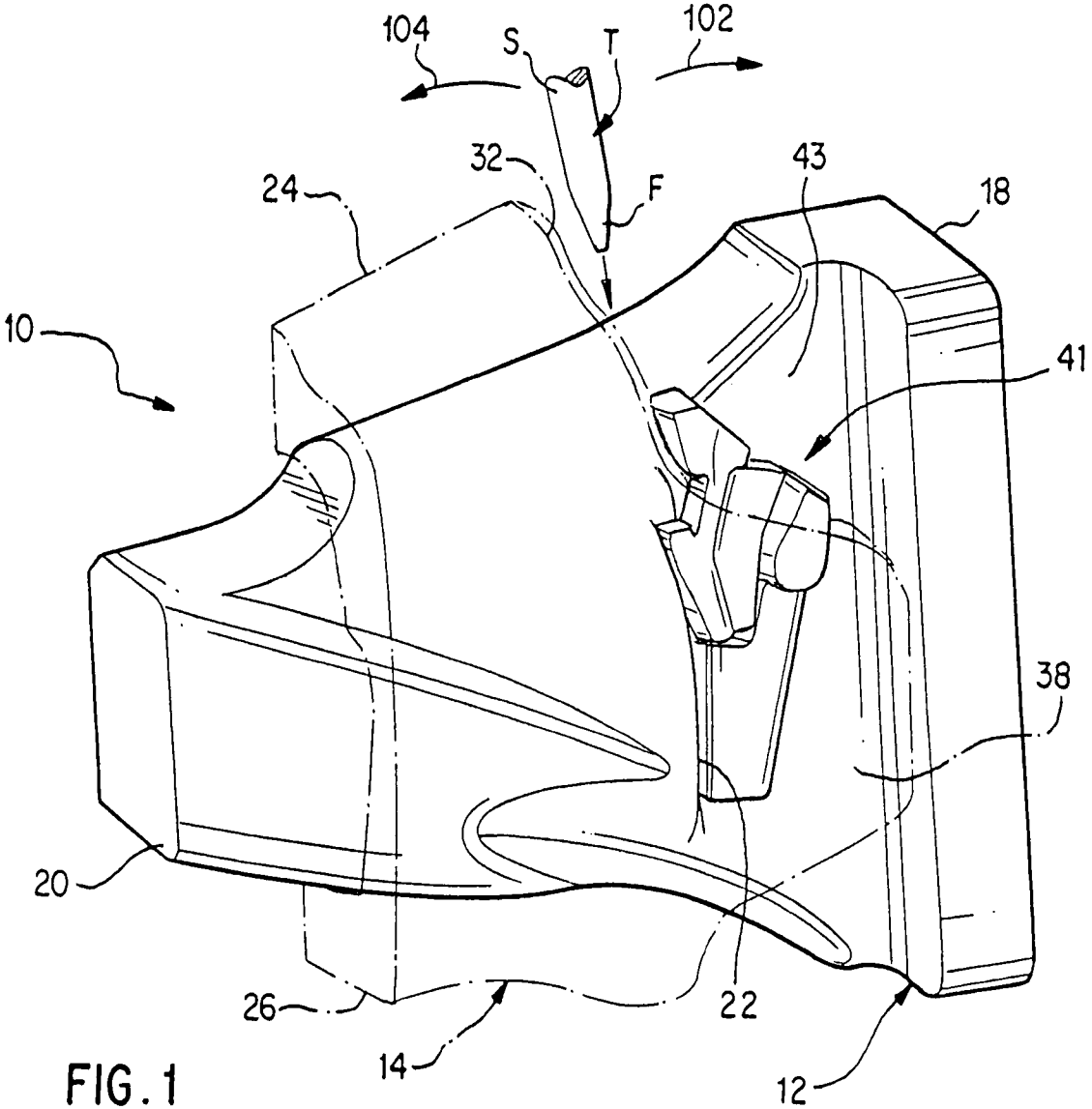
FIG. 1 is a partial perspective view of a tooth in accordance with the present invention with the tooth point shown in phantom.

The present invention pertains to a wear assembly for an excavator, and in particular to a coupling construction for securing a wear member to the digging edge of the excavator. In a preferred construction, the inventive coupling comprises an adapter 12, a wear member 14 and a lock to hold the wear member to the adapter. Several variations of the lock are disclosed below for use with essentially the same adapter 12 and wear member 14 (although some minor variations will be noted for some of the embodiments). Many variations in the adapter and wear member are possible. For convenience, the wear member below will be described as a tip or point for an excavating tooth, though the invention pertains to other wear members, such as shrouds, as well.

In a first embodiment, tooth 10 includes an adapter 12, a point or tip 14 and a lock 16 (FIGS. 1-7). The adapter has a mounting end 18 (not fully shown) that is adapted to be fixed to the front lip of an excavator by welding, mechanical attachment or being cast as a part of the lip. Typically, the mounting end includes a pair of bifurcated legs that straddle the lip and are welded in place. Although a one-piece adapter is shown, adapter 12 could also be composed of multiple parts with a base component fixed to the lip and a forward component defining the forwardly projecting nose. In a multi-piece adapter, the components are typically attached to each other by a removable lock member. In either case, a nose 20 of the adapter projects forwardly from the lip to support a point 14 (or other wear member). The nose can have essentially any configuration needed or desired to support a particular point. As an example only, the nose can have a configuration such as disclosed in U.S. Pat. No. 5,469,648, which is hereby incorporated by reference. In this example, the nose includes a rearwardly facing ledge 22 along one sidewall to abut a front surface of the lock 16 and form an external locking assembly.

While an external locking assembly is preferred for securing a tooth point to an adapter, the opening for receiving the tapered locks of the invention could extend through central portions of the nose and point either vertically or horizontally. In this case, the tapered shape of the opening would be formed primarily in the adapter nose rather than in point. Moreover, the opening could be formed in other constructions such as a mounting portion of a shroud or other wear member fit over a boss or the like fixed to an excavator. In this type of assembly, the opening could have a broader construction (i.e., not adapted to receive a pin-shaped lock) and/or have an open inlet end on various portions of the wear member by which to receive the lock.

In accordance with one construction of the invention, the point 14 has a generally wedge-shaped configuration with top and bottom walls 24, 26 that converge to a digging edge 27 (see, e.g., FIG. 8), and side walls 28, 29. A socket 30 opens in a rear wall 32 to receive nose 20 of adapter 12 (FIGS. 1-4). The interior wall 34 of socket 30 is shaped to complement the configuration of the nose. In this example, the socket and nose are formed with helical threads such as disclosed in U.S. Pat. No. 4,335,532, hereby incorporated by reference. Nevertheless, virtually any nose and socket configuration could be used in conjunction with the present invention. In this preferred construction, an ear 38 extends rearward of socket 30 beyond rear wall 32. The inner surface 40 of ear 38 includes a slot or opening 42. The slot in cooperation with ledge 22 and side 43 of the adapter defines a passage 41 for receiving the lock that holds the point to the adapter.

Figure 2:
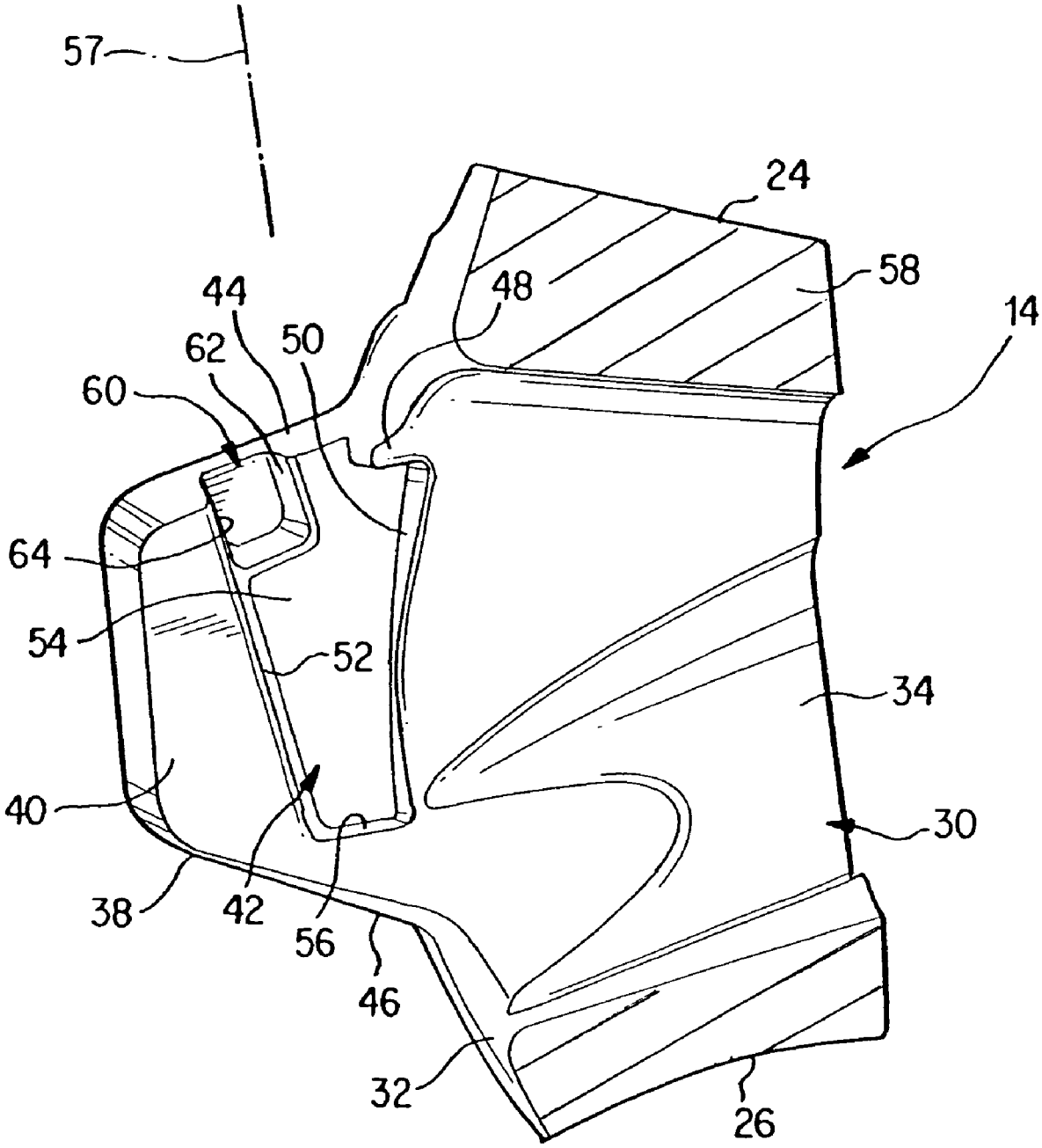
FIG. 2 is a partial sectional view of a point in accordance with the present invention as looking laterally outward from the longitudinal axis of the tooth.
Figure 3:
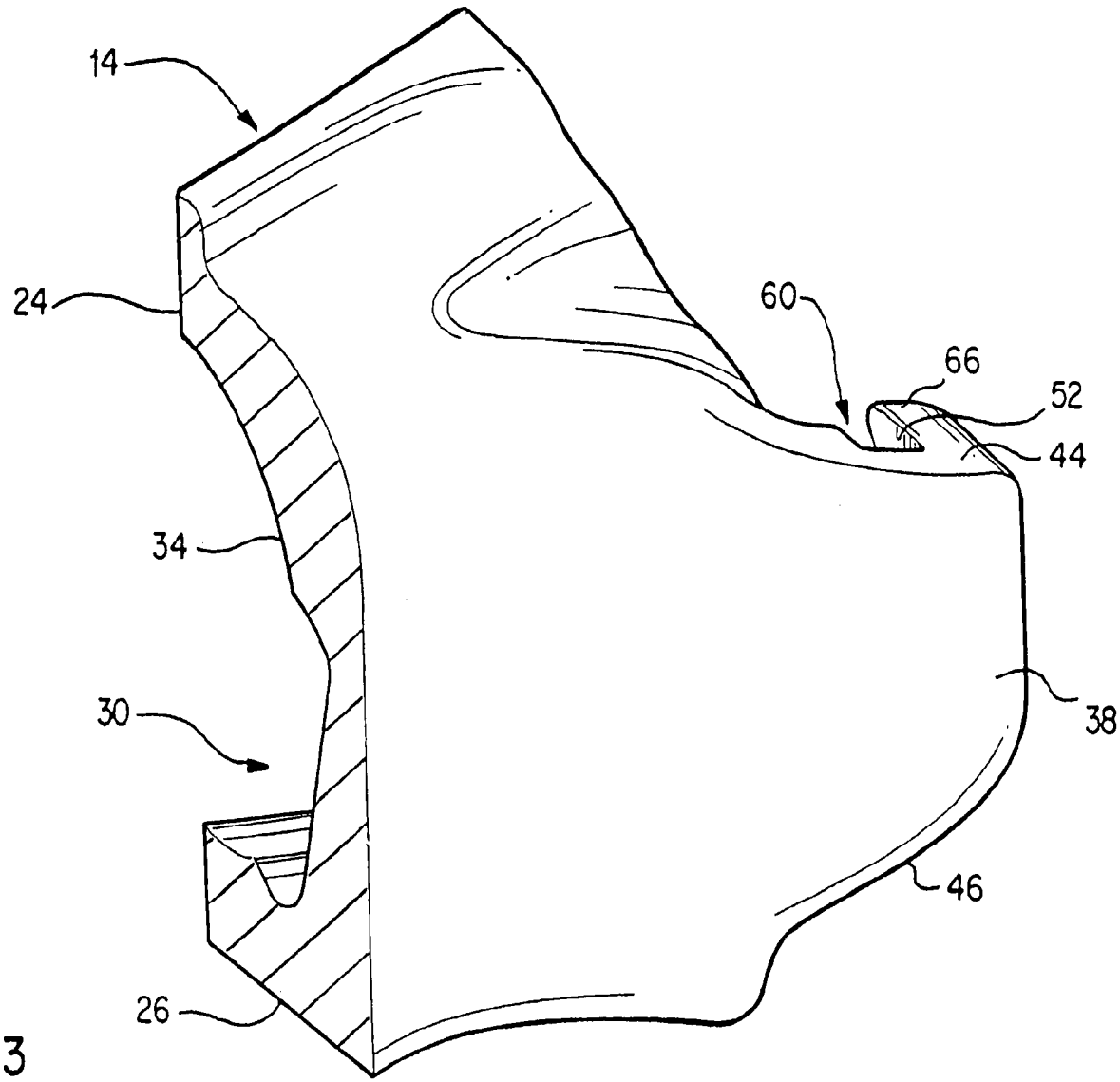
FIG. 3 is a partial side perspective view of the exterior of one rear side of the point.
Figure 4:
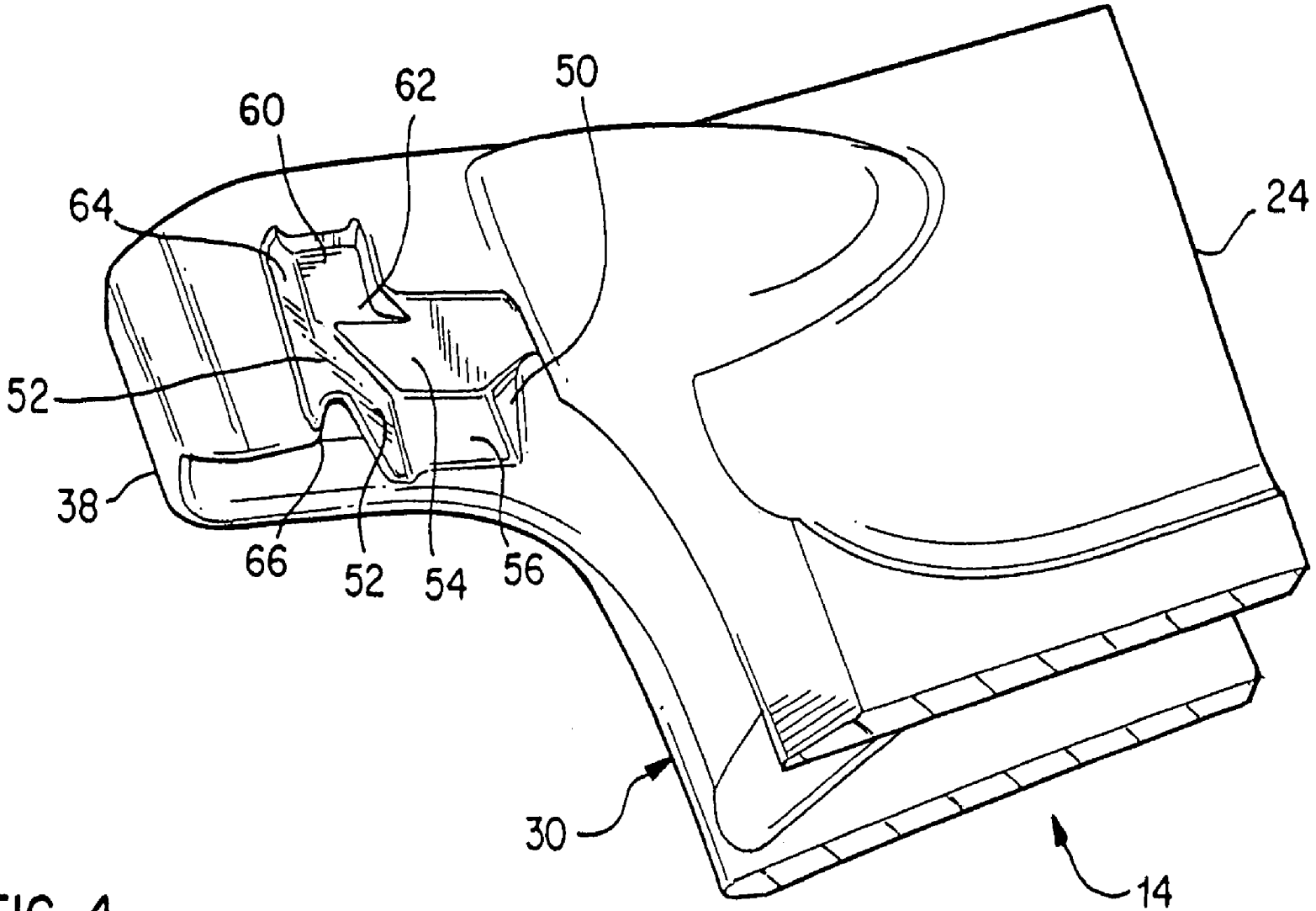
FIG. 4 is a partial top perspective view looking down into the slot defined in the point to receive the lock of the tooth.
Figure 6:
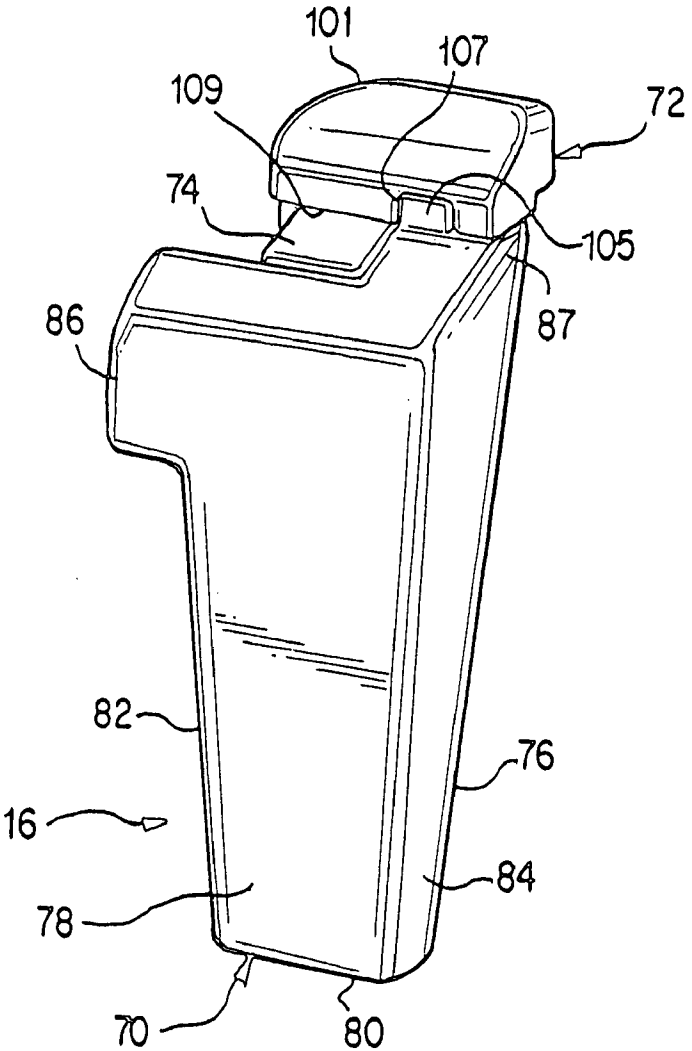
FIG. 6 is a rear perspective view of the lock of FIG. 5.
Figure 5:
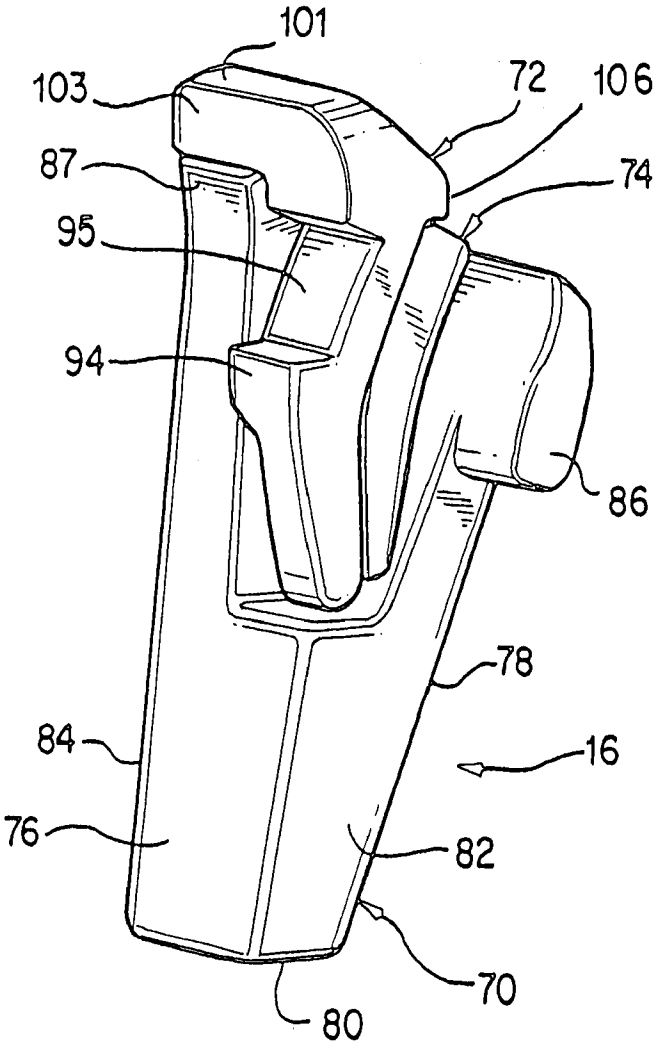
FIG. 5 is a front perspective view of a lock in accordance with the present invention.
Figure 7:
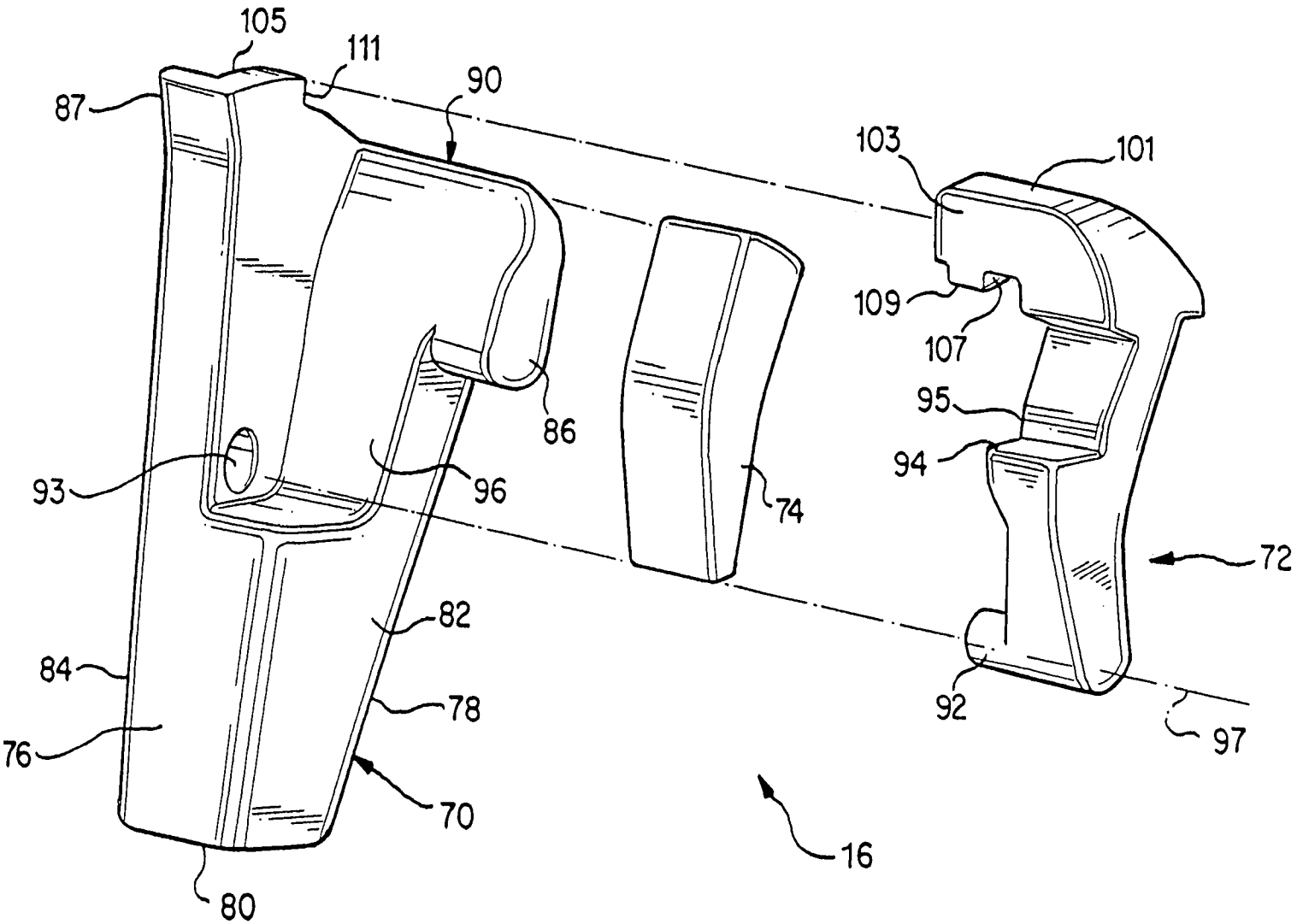
FIG. 7 is an exploded, perspective view of the lock of FIG. 5.

In one preferred construction, slit 42 opens along the top side 44 of ear 38 to define an inlet end 45 to receive the lock. The slot then converges or tapers toward the ear's bottom end 46 (FIGS. 2-4). The bottom end 46 is preferably closed to prevent fines from pushing up into the slot and applying upward pressure on the lock. Nevertheless, slot 42 could continue completely through ear 38 and define an open bottom end (not shown). In such an arrangement, slot 42 could taper continuously from top to bottom, or the bottom end of the slot could be defined by a stem portion extending below the lock in a linear configuration or having virtually any shape. The slot is further provided with a stop to hold the lock in the slot. In the preferred embodiment, the stop 48 is formed as a projection on point 14 to extend rearward of socket 30 above the top of slot 42 and cooperate with a latch to hold the lock in the slot. While stop 48 is shown as extending from the front wall 50 of slot 42, it could alternatively extend from the rear wall 52 or sidewall 54 of the point or from the adapter 12 with an appropriately structured lock. Moreover, although not illustrated, the stop could be a cavity that receives a projection of the latch, or a latch that projects and fits into an opening in the lock.

In the preferred construction, slot or opening 42 is tapered in three directions to receive a comparably shaped lock in order to provide easy insertion and removal for lock 16, and a greater bearing surface with which to resist loads (FIGS. 1-4), although tapering in only one direction can provide benefits of the invention. First, the front and rear walls 50, 52 converge as they extend toward bottom wall 56. The rear wall 52 is the primary bearing surface that engages the lock and holds the point to the adapter, and is thus preferably flat. Nevertheless, the front and rear walls 50, 52 can be flat, curved, V-shaped or have another configuration, so long as they converge along the length of the slot adapted to receive the lock. While walls that converge over all or substantially all of the length of the slot are preferred, the walls can converge over only a part of their lengths. For example, a small length of the slot (e.g., at the bottom end of the slot) could have a non-converging configuration provided the resistance caused by such a non-converging segment does not hinder the ability to pry the lock into and out of the slot. Further, portions of the slot could have a wide variety of configurations (e.g., linear, downwardly diverging, irregular, or downwardly converging at various angles) that may not converge or engage the lock, so long as a sufficient portion of the slot converges and engages the lock when fully inserted to provide ample support for the lock during use without hindering the lock from being pried into and out of the opening.

Second, the widths of front and rear walls 50, 52 each widen as they extend from the bottom wall 56 to the open top end of the slot, so that the front and rear walls 50, 52 are wider at the top than the bottom of slot 42. In other words, sidewall 54 is inclined to the vertical axis 57 so that the sidewall 54 and vertical axis 57 converge toward bottom wall 56. In this arrangement, the sidewall 54 of the slot is inclined relative to a central plane of the socket 30 that bisects side walls 28, 29 of the point and extends along the longitudinal axis of the socket (i.e., the axis of insertion of the nose in the socket), such that the sidewall 54 of the slot converges toward the central plane of the socket as the sidewall 54 extends away from the inlet end 45 of the slot. While a snug engagement is preferred when the lock is fully fitted into passage 41, sidewall 54 could extend substantially parallel to axis 57 provided the lock is not tightly held between sidewall 54 and the side 43 of adapter 12 such that the lock could not be pried into and out of passage 41.

Finally, slot 42 also preferably widens from the front wall 50 to the rear wall 52 such that bottom wall 56 expands in the rearward direction and the portions of the rear wall 52 are wider than the corresponding portions of the front wall 50. The widening of slot 42 from front to back creates a rear wall 52 that is wider than the front wall 50 to provide a larger surface area with which to resist the greater forces that are ordinarily applied to this surface in holding the point to the adapter. Front wall 50 is preferably narrower than rear wall 52 to provide greater strength to the coupling of ear 38 to body 58 of point 14. While the widening of the slot from front wall 50 to the rear wall 52 is preferred, it could be eliminated if desired.

A notch 60 is preferably provided in the upper rear corner of slot 42 to increase the bearing surface of rear wall 52 without unduly weakening the strength of ear 38 and to prevent rotation of the lock, particularly under heavy loading. Since the ear is laterally offset from ledge 22, a forwardly directed force on point 14 can generate a torque on the lock, which is resisted by the generally rectangular cross section of the lock and a protrusion received in notch 60, as described more fully below. As with slot 42, notch 60 is also preferably tapered in three directions such that (1) the front and rear faces 62, 64 diverge as they extend toward the open top end 44 of slot 42, (2) the front and rear faces 62, 64 widen as they extend toward the open end of the slot, and (3) the rear face 64 is wider than opposing portions of front face 62. Nevertheless, other arrangements for the notch are possible. Rear wall 52 is also preferably provided with an additional inward extension 66 at its top end to further increase the surface area of the rear wall and provide a portion more directly opposed to ledge 22 without hindering the mounting of the point on the adapter. While the use of notch 60 is preferred, it could be eliminated for some uses or replaced by other means for preventing rotation of the lock.

In a first embodiment, lock 16 includes a body 70, a latch 72 and a resilient member 74 (FIGS. 1 and 5-7). Body 70 has front and rear surfaces 76, 78 that are preferably shaped to correspond with and abut against front and rear walls 50, 52 of slot 42 when the lock is fully inserted into the slot, i.e., the front surface 76 of lock 16 abuts front wall 50 and rear surface 78 abuts rear wall 52. While front and rear surfaces 76, 78 and front and rear walls 50, 52 could be only partially engaged, they are preferably in substantially full bearing engagement with each other along the length of slot 42. In this way, the lock is stably supported in the ear of the point when under duress, and when looseness and wear develops in the tooth assembly.

In the preferred construction, lock 16 is shaped to be matingly received in slot 42. Accordingly, lock 16 is preferably tapered in three directions. First, front and rear surfaces 76, 78 converge as they extend toward the bottom surface 80 of the lock. Second, side surfaces 82, 84 of body 70 also converge as they extend toward bottom surface 80. Third, side surfaces 82, 84 converge as they extend toward front surface 76. With this tapered construction, the lock can be easily placed into and out of the tooth without hammering. In particular, unlike conventional lock pins with parallel sides where substantial friction is encountered between the pin and the sides of the passage, the surfaces 76, 78, 80, 82 of lock 16 are not pressed into face-to-face frictional sliding contact with opposing walls 50, 52 and 43, 54 until the lock is fully set in slot 42. The taper of front and rear surfaces 76, 78 is important because it provides a good fit between the lock and the slot in the longitudinal direction (i.e., in the direction of greatest loading) when the lock is fully fitted, but avoids the face to face sliding frictional contact during insertion. While the tapering of the lock in the other two orthogonal directions is preferred, the side surfaces 82, 84 can be substantially parallel in a vertical direction (i.e., without tapering toward button surface 80), if the lock is not too tightly received between sidewall 54 and side 43 so as to prevent the lock from being pried into and out of the opening. Moreover, side surfaces 82, 84 can also be substantially parallel in the longitudinal direction (i.e., without side surfaces 82, 84 tapering toward front surface 76) provided sufficient surface area contact exists between rear wall 52 and rear surface 78 for the expected loads.

A protrusion 86 is provided on the top end of side surface 82 to fit within notch 60. Preferably, protrusion 86 matingly fits within notch 60 when lock 16 is fully fitted within slot 42. Body 70 is laterally wider than slot 42 so that the lock extends inward from ear 38 to engage ledge 22 of adapter 12. As noted above, the offset construction of ear 38 and ledge 22 places a torque on the lock that is resisted by the generally rectangular cross-section of body 70 and the receipt of protrusion 86 in notch 60.

In the preferred construction, body 70 further includes a front support 87 that extends forward, above slot 42, to abut rear wall 32 of point 14. This additional engagement between the lock and the point helps to stabilize the mounting of the lock in slot 42. Then, if looseness develops in the tooth on account of wear or because of other reasons, the lock is stably held to the point the reduce the likelihood of losing the lock.

Latch 72 and resilient member 74 are each received within a recess 90 defined in an upper portion of body 70. The latch 72 includes a pivot pin 92 at its lower end that is received within a hole 93 to define a pivot axis 97. Accordingly, the latch moves about axis 97 between a latched condition where the lock is held within slot 42 and an unlatched condition where the lock can be removed from the slot. A shoulder 94 is preferably formed along a mid portion of the latch 72 to engage stop 48 in the latched condition. An opening 95 is defined above shoulder 94 to accommodate receipt of stop 48.

The upper portion 101 of latch 72 preferably extends laterally over the top of body 70. The front face 103 defines a pry surface whereby latch 72 can be moved to the unlatched condition. A guide rail 105, formed along the top of body 70, is received in a complementary groove 107 in the lower face 109 of upper portion 101. This rail and groove 105, 107 construction stabilizes the movement of the latch on the body, prevents the latch from moving laterally out of recess 90, and maintains pivot pin 92 in hole 93. The rear end of the groove 107 includes a rear wall (not shown) that contacts abutment 111 at the rear end of guide rail 105 to limit the outward pivoting of the latch and thereby define the latched condition. Preferably, the upper portion 101 is spaced slightly rearward of front support 87 in the locked condition so that contact with the rear wall 32 does not push on the latch.

Resilient member 74 is sandwiched between latch 72 and support surface 96 of recess 90 to normally bias the latch into the latched condition. Resilient member 74 is preferably an elastomer, such as neoprene or rubber, but could be composed of other resilient materials or involve other springs (not shown). The resilient member is preferably held in place by the compression forces applied by the latch 72 and support surface 96, i.e., abutment 111 is preferably set to stop latch 72 so that resilient member 74 is always under a compressive load. Nonetheless, resilient member 74 could be secured to latch 72 and/or support surface 96 by an adhesive or by molding the elastomer to one of these components. The latch 72 further preferably includes a finger 106 that overlies at least a portion of resilient member 74 to protect it and prevent its release upward, particularly when the resilient member is retained only by compressive forces. To remove lock 16 from slot 42, the latch is moved toward support surface 96, against the bias of resilient member 74, to the unlatched condition, i.e., where shoulder 94 releases stop 48.

In use, point 14 is fit onto adapter 12 such that nose 20 is received into socket 30 (FIG. 1). In this construction, the slot 42 defined in ear 38 is positioned rearward of ledge 22. Once the point is fully placed on the adapter nose, lock 16 is inserted into passage 41 defined by slot 42, ledge 22 and side 43. Because of the tapered construction of slot 42 and lock 16, the lock fits into the slot without hammering. While it may be possible in some constructions to insert the lock without tools, the desire for a tight fit of the point onto the adapter typically prevents the lock from being manually fit entirely into position within slot 42 without tools. The lock is preferably pried into its set position through the use of a prying tool T. The free end F of the prying tool is set against the tooth so that the free end engages rear wall 32 and the shank S of the tool lies against the top of upper portion 101 of latch 72 (FIG. 1). The free end F of the pry tool T is anchored for prying by an additional tab (e.g., as in FIG. 42) or by a certain configuration already existing in the assembly. The prying tool T is then forced rearward and downward (generally in the direction of arrow 102) through manual pressure, with the free end of the tool acting as a fulcrum, to push downward on the upper portion 101 of the latch and set lock 16 in place. As the lock is moved into passage 41, stop 48 presses latch 72 rearward against resilient member 74 until the latch clears the stop, at which time the latch snaps into the latched condition to hold the lock in slot 42. Although prying is preferred, the lock could be inserted with a hammer if desired. Even if a hammer is used, the process of inserting the lock is greatly eased by the tapering of lock 16 and slot 42. In the fully inserted position, lock 16 is preferably matingly received in slot 42 such that the front, rear and side surfaces 76, 78, 82 of lock 16 abut against the front, rear and side walls 50, 52, 54 of slot 42, respectively. In addition, front support 87 abuts rear wall 32 of point 14.

Lock 16 is wider than slot 42 such that the lock extends laterally out of the slot to engage ledge 22 of adapter 12. In most assemblies, the insertion of the lock causes the front surface 76 of lock 16 to press against ledge 22 of adapter 12 and the rear surface 78 to press against rear wall 52 of slot 42 to pull point 14 farther onto adapter 12. Once in a fully inserted position, the front surface 76 opposes ledge 22 and rear surface 78 opposes rear wall 52 to hold the point to the adapter. Since the lock is received in slot 42 and retained by the engagement of stop 48 and latch 72, the lock will stay in slot 42 and still hold the point to the adapter even if wearing of the components creates a looseness or gaps between the front surface 76 and ledge 22.

Lock 16 is preferably also pried out of slot 42 by prying tool T when it is desired to remove the point from the adapter. The free end of the prying tool is inserted between the prying face 103 of latch 72 and rear wall 32. The top end of the pry tool is then pushed forward and downward (generally in the direction of arrow 104), with the rear of point 14 forming the fulcrum, so that the free end F is rotated rearward and upward. This movement of the pry tool first pushes latch 72 rearward to its unlatched condition, and then pushes the lock upward at least partially and out of the slot. The interconnection of the pivot pin 92 in hole 93 enables the lock to be pried out of the slot through engagement with the latch. Although prying is the preferred method of removing lock 16, the lock could be removed by hammering if slot 42 included a portion that extended entirely through ear 38, provided the latch is first released by a tool.

While the latch assemblies for lock 16 and the other below described locks are preferably used in tapered locks, the latch constructions described for the various locks herein could be used in locks that have non-tapering bodies and/or that are intended to be inserted into and removed from a tooth assembly by hammering.

Moreover, the latches could also be used to secure a lock within an excavating wear assembly wherein the lock body has a shape other than an elongated pin configuration (e.g., a block shape). As an example only, the latch constructions described herein could be incorporated into a block-shaped lock such as described in U.S. Pat. No. 5,653,048, hereby incorporated by reference, in lieu of the latch arrangement disclosed therein to retain the lock in the opening. Using lock 16 as an example, a recess and hole, like the recess 96 and hole 93 in lock 16, could be formed in the block-shaped lock body to receive a similar latch and resilient member. The latch would then move in essentially the same way between a latched condition in engagement with a keeper and an unlatched condition to permit removal of the lock. The other latch constructions disclosed herein could also be similarly configured with a block-like body as opposed to a pin-shaped body.

Figure 8:
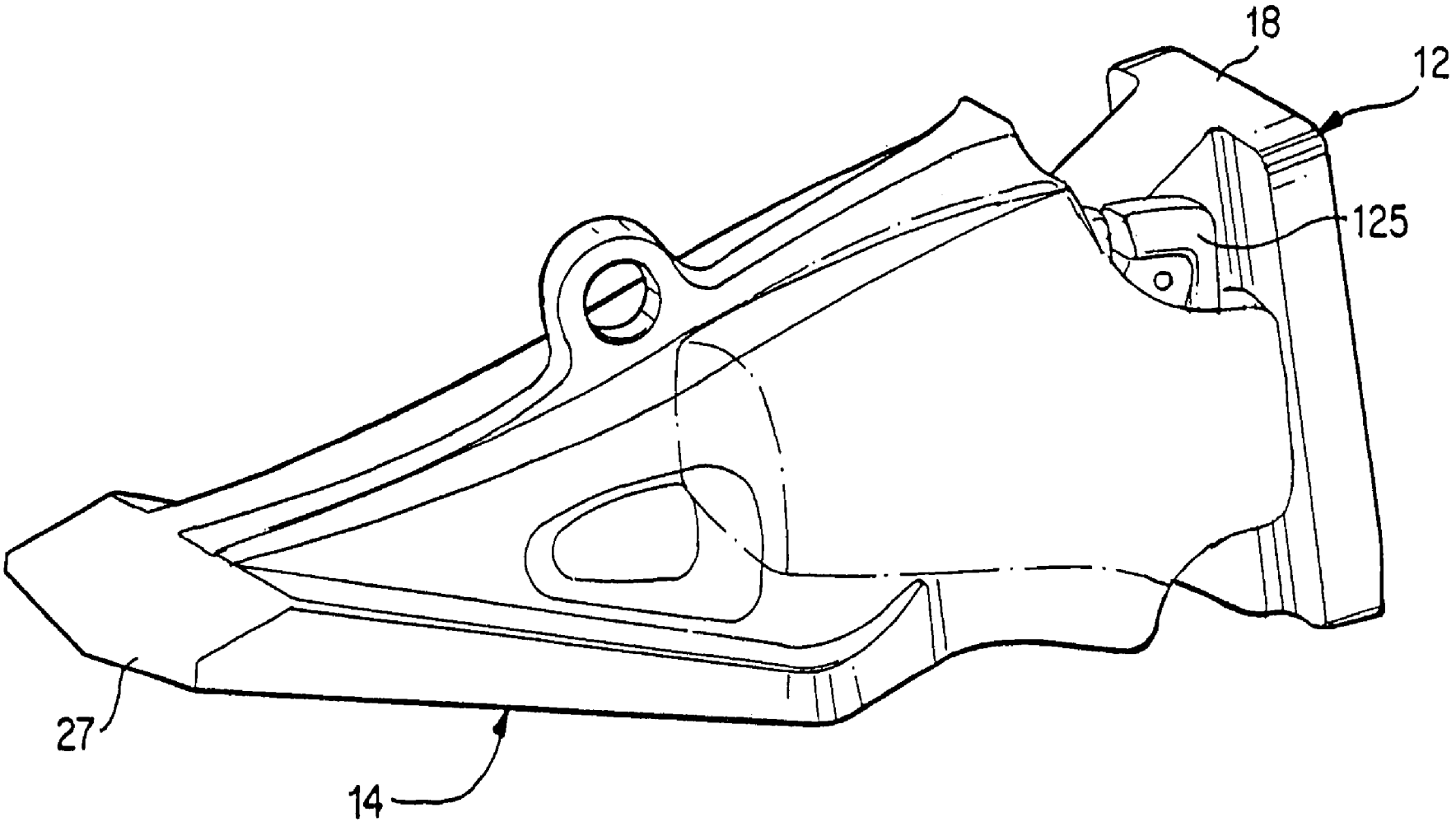
FIG. 8 is a partial perspective view of a tooth with another embodiment of the lock.
Figure 10:
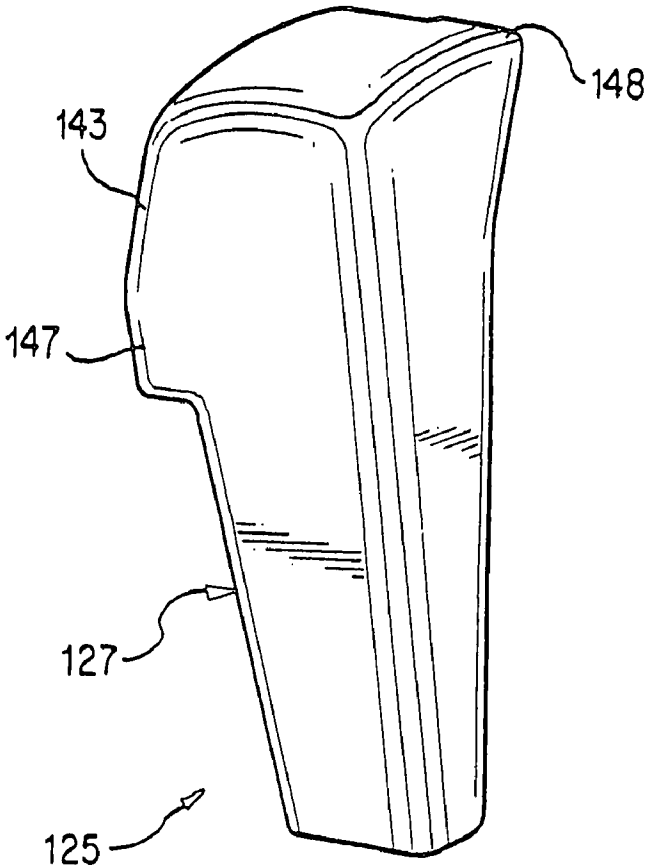
FIG. 10 is a rear perspective view of the lock of FIG. 8.
Figure 9:
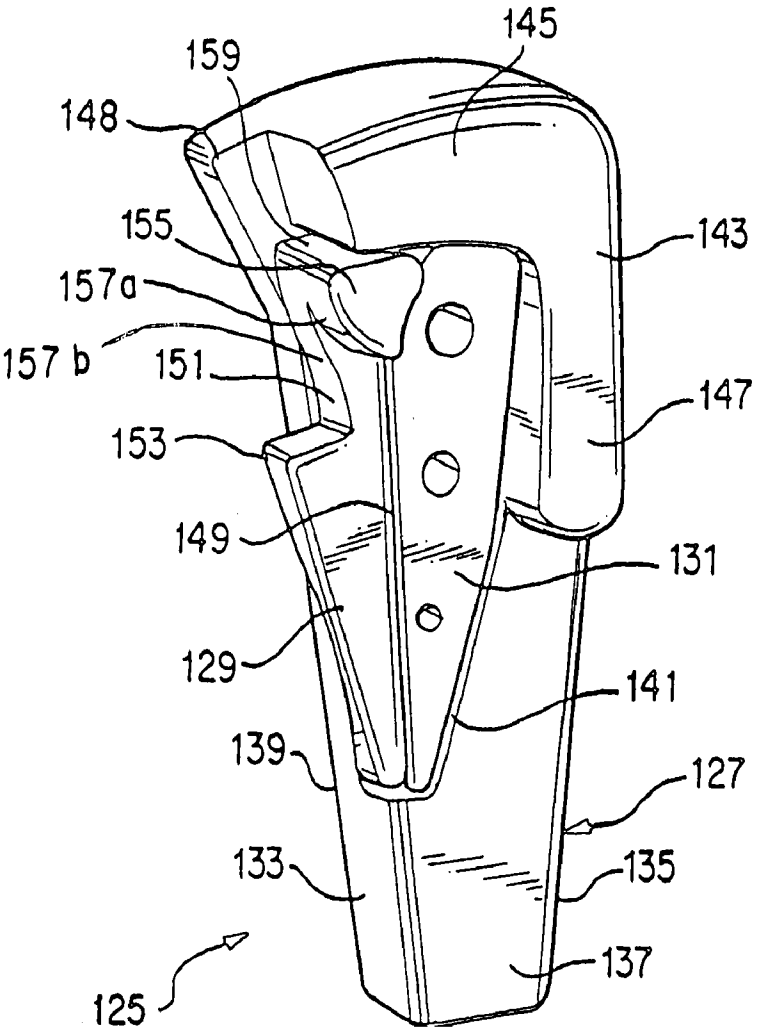
FIG. 9 is a front perspective view of the lock of FIG. 8.
Figure 11:
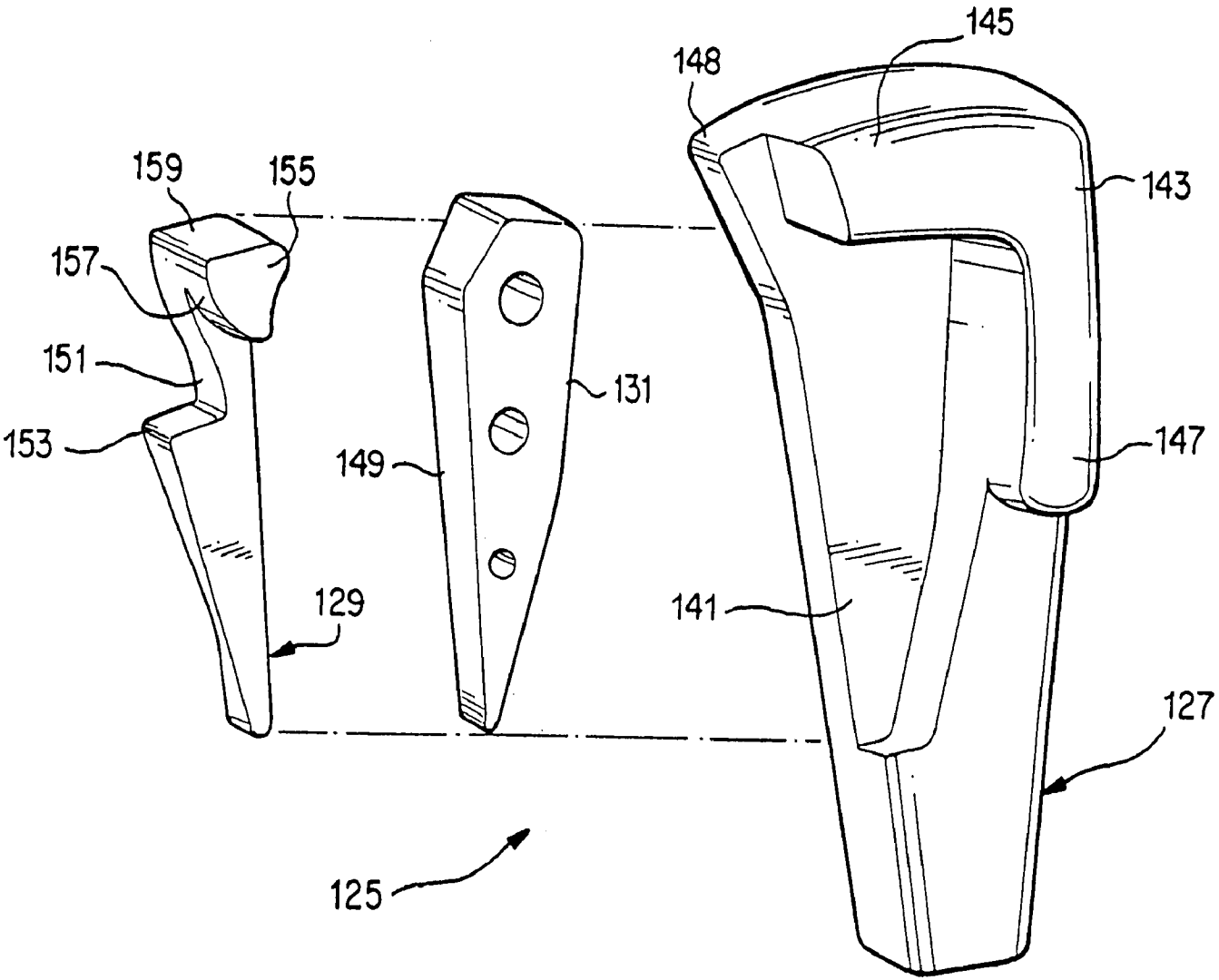
FIG. 11 is an exploded, perspective view of the lock of FIG. 8.

In another embodiment of the invention, lock 125 is inserted into passage 41 to hold the point to the adapter (FIG. 8). Lock 125 comprises a body 127, a latch 129 and a resilient member 131 (FIGS. 9-11).

Body 127 has a front surface 133, a rear surface 135 and side surfaces 137, 139. As with lock 16, lock 125 preferably tapers in three directions: (1) front and rear surfaces 133, 135 converge as they extend toward bottom surface 141; (2) side surfaces 137, 139 converge as they extend toward bottom surface 141; and (3) side surfaces 137, 139 converge as they extend toward front surface 133. Nevertheless, the alternative structural variations discussed in regard to the body of lock 16 are also applicable to the body 127 of lock 125.

A recess 141 is formed in an upper portion of body 127 to receive latch 129 and resilient member 131. A generally L-shaped hood 143 is formed to extend with one leg 145 over recess 141 and the other leg 147 along the rear side of the recess. The lower end of leg 147 is preferably shaped to be received in notch 44 to provide a greater surface area to abut rear wall 52 of slot 42 and to resist rotation of the lock under loading. Leg 145 protects resilient member 131 from wearing and provides support to lift lock 125 from passage 41. Further, front support 148 projects beyond leg 145 to contact the rear wall 32 of point 14 to help stabilize the mounting of the lock in the point.

Resilient member 131 is preferably an elastomer composed of neoprene, rubber or the like. The resilient member is preferably molded into the recess, although it could be secured with adhesive or the lock configured to mechanically retain the elastomer in place. Latch 129 is preferably adhered to the front surface 149 of resilient member 131. Latch 129 includes a recess 151 and a shoulder 153 for receiving and engaging stop 48 of point 14 to hold lock 125 in slot 42. A prying protrusion 155 with a prying surface 157 is formed on the top end of latch 129.

In use, lock 125 is inserted into; slot 42 when the point has been placed onto adapter nose 20 (FIG. 8). As with the first embodiment, a prying tool is inserted between rear wall 32 of point 14 and lock 125, and rotated rearward and downward so that the prying tool pushes lock 125 downward into slot 42. Rear surface 135 of lock 125 engages rear wall 52 of slot 42 and front surface 133 preferably pushes against ledge 22 of adapter 12 to pull point 14 tightly onto nose 20 as the lock is inserted. This downward movement of lock 125 is continued until shoulder 153 engages stop 48. As can be appreciated, resilient member 131 permits the latch 129 to move rearwardly when shoulder 153 is moved past stop 48, and causes the shoulder 153 to snap back into its latched condition in engagement with stop 48 when the lock is fully inserted into slot 42. In the preferred construction, lock 125 sets in slot 42 in the same way as lock 16.

To remove lock 125 from slot 42, the prying tool is again inserted between rear wall 32 of point 14 and lock 125. The prying tool is rotated forward and downward so that the free end of the prying tool engages prying surface 157 of latch 129 to retract shoulder 153 from stop 48 and to pull lock 125 at least partially out of passage 41. The tool presses on prying surface 157*a* or 157*b*. Although there is no pivot pin for the latch in this embodiment, latch 125 essentially moves in a similar pivoting movement about its bottom end as it is pushed rearward at its top end by the prying tool. The top surface 159 of latch 129 abuts leg 145 of body 127 to provide support for removal of lock 125 from slot 42.

Lock 125*a* (FIGS. 12-15) is a lock that is in many ways a combination of locks 16 and 125. Lock 125*a* includes a body 127*a*, a latch 129*a* and a resilient member 131*a*. In the same way as lock 125, body 127*a* preferably tapers in three directions. Body 127*a* also includes a recess 141*a* bounded along a top portion by a generally L-shaped hood 143*a* having one leg 145*a* over recess 141*a* and a lower leg 147*a* along the rear side of the recess. The bottom end of leg 147*a* is received into the notch as with leg 147. In this embodiment, the protrusion is illustrated with a squared off shape to illustrate an alternative construction of the notch and protrusion. The front support 148*a* projects forward of leg 145*a* and latch 129*a* to abut rear wall 32 of point 14 when the lock is fully inserted in slot 42.

Like lock 16, latch 129*a* includes a lower pivot pin 92*a* that fits within hole 93*a* defined in body 127*a*. The latch 129*a* includes a shoulder 94*a* that is biased forward by resilient member 131*a* into a latched condition with stop 48 when the lock is in the fully inserted position. As with resilient member 131, resilient member 131*a* is formed with holes 132*a* to accommodate compression of the assembly When the latch 129*a* is pressed rearward. The holes 132*a* are preferably filled with compressible foam to prevent fines from compacting into them during use. Body 129*a* is shown with an expansion port 134*a* in its rear face 135*a* (FIGS. 14 and 15), that permits additional room for the resilient member 131*a* to expand; that is, the resilient member is preferably formed of a non-compressible material, such as rubber, and may need more room to expand when the latch is pressed rearward than provided by holes 132*a*. Alternative or other expansion ports could also be formed in the body so long as the strength of the body was not compromised for its intended use. Moreover, such expansion ports could be used with any of the embodiments, disclosed herein. Alternatively, the resilient member could be composed of a compressible material such as foam rubber.

Figure 15:
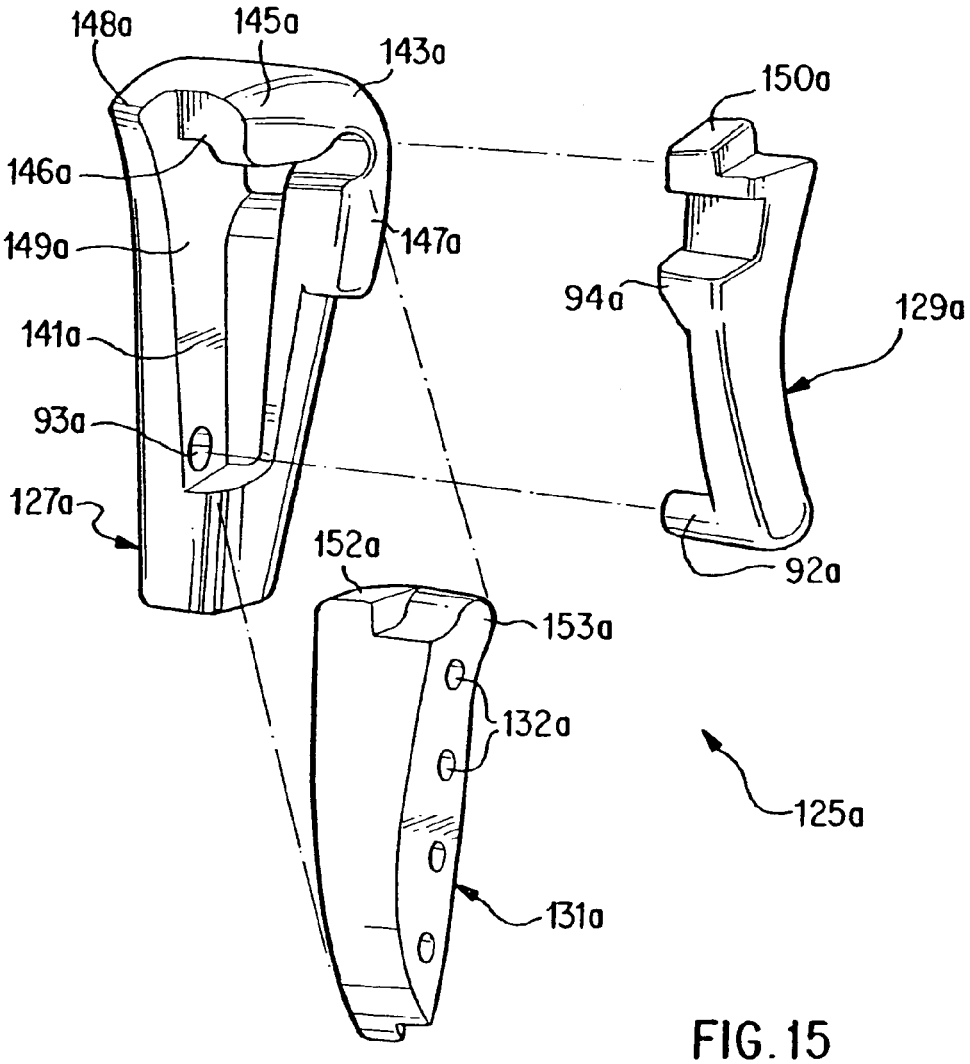
FIG. 15 is an exploded, perspective view of the lock of FIG. 12.

In this embodiment, top leg 145*a* defines a groove 146*a* extending along sidewall 148*a* of recess 141*a*. As seen in FIG. 15, a ridge 150*a* is formed along the top of latch 129*a* to fit within the groove and thereby retain and guide the movement of the latch. Similarly, resilient member 131*a* include a ridge 152*a* also received in groove 146*a* to better retain the parts in recess 141*a*. The resilient member further preferably includes a bulb-like formation 153*a* that fits within a similarly shaped cavity at the intersection of legs 145*a*, 147*a* to prevent forward movement of the resilient member out of the recess 141*a*. Also, as with lock 125, latch 129*a* and resilient member 131*a* are preferably bonded together by adhesive or molding the components together. The insertion and removal of lock 125*a* from the tooth is essentially the same as described above for lock 125.

In another alternative similar to locks 16 and 125, lock 125*b* includes a body 127*b* that preferably tapers in three directions. Body 127*b* defines a recess 141*b* that is adapted to receive a resilient member 131*b* and latch 129*b*. In this embodiment, the latch 129*b* is composed of a sheet metal material that is shaped to conform to the outer edge of resilient member 131*b*. Although the strength of the latch 129*b* is generally less than these in the other embodiments, this latch is easy and economical to make and does not require the latch and resilient member to be adhered together by adhesive or being molded together. The bottom pivot 132*b* is formed by shaping the bottom portion of the latch and resilient member into a rounded configuration that fits into a rounded cavity 134*b* in body 127*b*. The front of pivot 132*b* includes a flat 136*b* that abuts against a stop surface 138*b* on body 127*b* to limit the forward pivoting of the latch.

Body 127*b* includes a hood 153*b* with a top leg 145*b* and a lower leg 147*b*. Top leg 145*b* overlies and protects the resilient member, and overlies the latch 129*b* when the latch is retracted to its release position to provide support for removing the lock from the excavating tooth. The lower leg 147*b* wraps around the top of the resilient member to provide extra support to better maintain the shape of the resilient member and latch. The bottom of the lower leg 147*b* is intended for receipt in the notch of the point, but is illustrated with a different configuration to show another alternative. As with lock 125*a*, front support 148*b* projects forward of latch 129*b* and top leg 145*b*.

Lock 125*c* is similar to lock 125*b* in construction of the body 127*c* and resilient member 131*c*. The latch 129*c* is similar to latch 129*b* but instead of being fabricated of sheet metal is a part that is formed by casting, forging or the like.

In lock 125*c*, a catch 132*c* is formed at the top of the hood 143*c* to temporarily hold the latch in a release or unlocked condition. In particular, a pry tool is inserted between the rear face 32 of point 14 and lock 125*c* and rotated forward so as to push latch 129*c* rearward. This prying motion pushed the latch rearward and upward so that the top of the latch hooks onto the catch 132*c*. Then the pry tool can be used to pry the lock at least partially out of slot 42.

Figure 17:
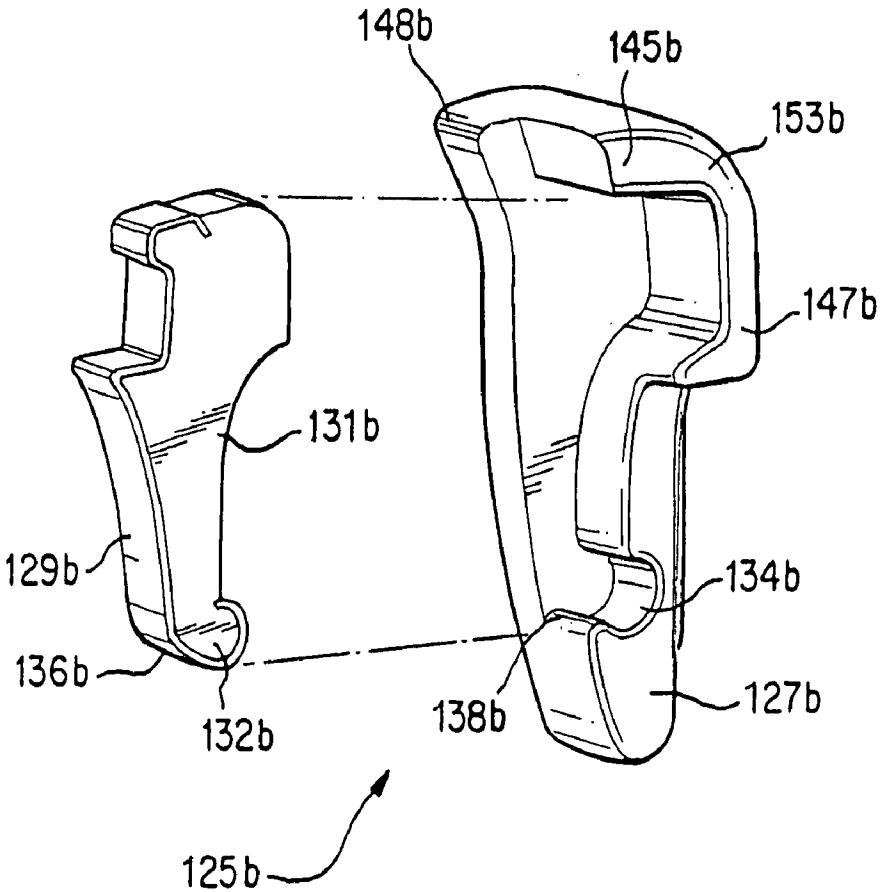
FIG. 17 is an exploded, perspective view of the lock of FIG. 16.
Figure 16:
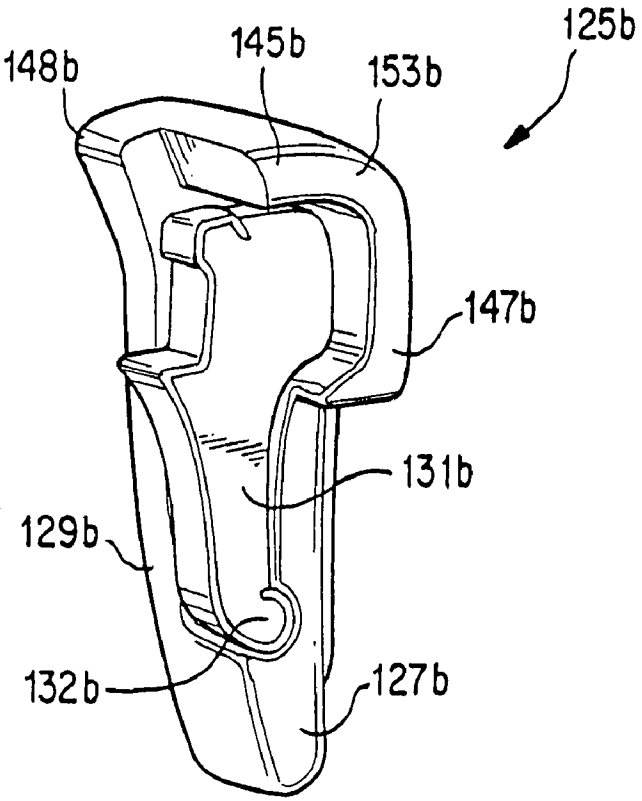
FIG. 16 is a front perspective view of another embodiment of the lock.
Figure 18:
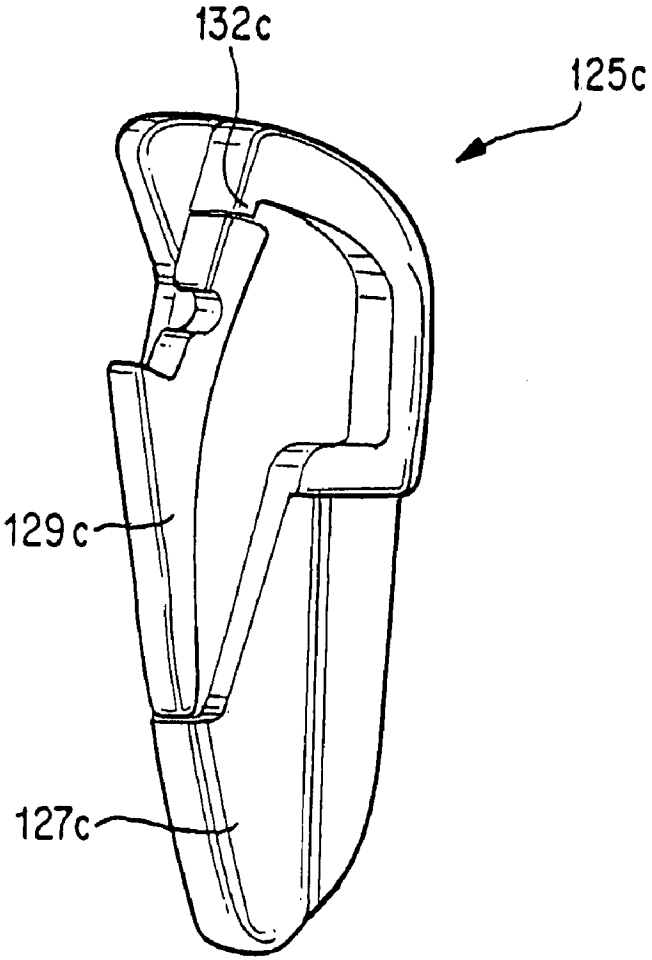
FIG. 18 is a front perspective view of another embodiment of the lock with the resilient member omitted.

In another embodiment of the invention, lock 166 is inserted into passage 41 to hold the point to the adapter (FIG. 16). Lock 166 includes a body 168, a latch 170 and a resilient member 172 (FIGS. 17-18).

Body 168 includes a front surface 174, a rear surface 176 and side surfaces 178, 180. As with the above-described locks, lock 166 preferably tapers in three directions. Front and rear surfaces 174, 176 of body 168 converge as they extend toward bottom surface 182. Likewise, side surfaces 178, 180 of body 168 also converge as they extend toward bottom surface 186. Finally, side surfaces 178, 180 converge as they extend toward front surface 174 to provide a rear surface 176 that is wider than front surface 174. In this way, side surface 178 generally parallels sidewall 54 of slot 42. As with the above lock 16, the front, Tear and side surfaces 174, 176, 178, 180 could be varied in their shapes and orientations. A protrusion 184 extends laterally from side surface 178 to fit in notch 60, and a front support 185 projects forwardly to abut rear face 32.

A recess defined as a channel 186 is formed in an upper portion of lock 166. Channel 186 is defined by top and bottom surfaces 187, 188 and is preferably curved with a concave-up configuration; nevertheless, the channel could have a linear configuration if desired. The channel extends through the lock body 168 and opens in both the front and rear surfaces 174, 176. The channel is oriented to swing upward in a rearward direction such that the channel opening in rear surface 176 is closer to top surface 189 of body 168 than the channel opening in front surface 174. In the preferred embodiment, the upper surface 190 of protrusion 184 is an extension of the bottom wall 192 of the channel.

Latch 170 has an arcuate configuration to slide in channel 186. More specifically, latch 170 includes a front portion 194 and a rear portion 198. The front portion has a free end 196, which is adapted to engage stop 48 of point 14 in a forwardly protruding latched condition. Rear portion 198 is preferably wider than front portion 194 to take advantage of the wider bottom surface 188 of channel 186 provided by protrusion 184. The top surface 187 of channel 186 has generally the same width as rear portion 198. A flange-like base element 201 is provided at the intersection of front and rear portions 194, 198 to define a support for resilient member 172.

Resilient member 172, as with the above locks, is preferably an elastomer composed of neoprene, rubber or the like. In the preferred construction, resilient member 172 is a short curved segment set between the upper face 203 of rear portion 198 of latch 170 and top surface 187 of channel 186, and between the pushing surface 205 of base element 201 and the bottom surface 209 of cover element 211 of body 168. In this way, resilient member 172 pushes against pushing surface 205 to bias latch 172 forward to the latched condition so that the free end 196 normally protrudes beyond front surface 174 to engage stop 48 and hold lock 166 in slot 42. A stop element 213 is preferably formed at the free end of top surface 187 to abut the front end 215 of base element 201 to limit the forward motion of latch 170. The latch and resilient member are preferably held to body 168 by always maintaining the resilient member under a compressive force. Nevertheless, resilient member 172 may be provided with an adhesive to secure the ends 217, 219 to base element 201 and cover element 211, or secured by mechanical means.

Figure 12:
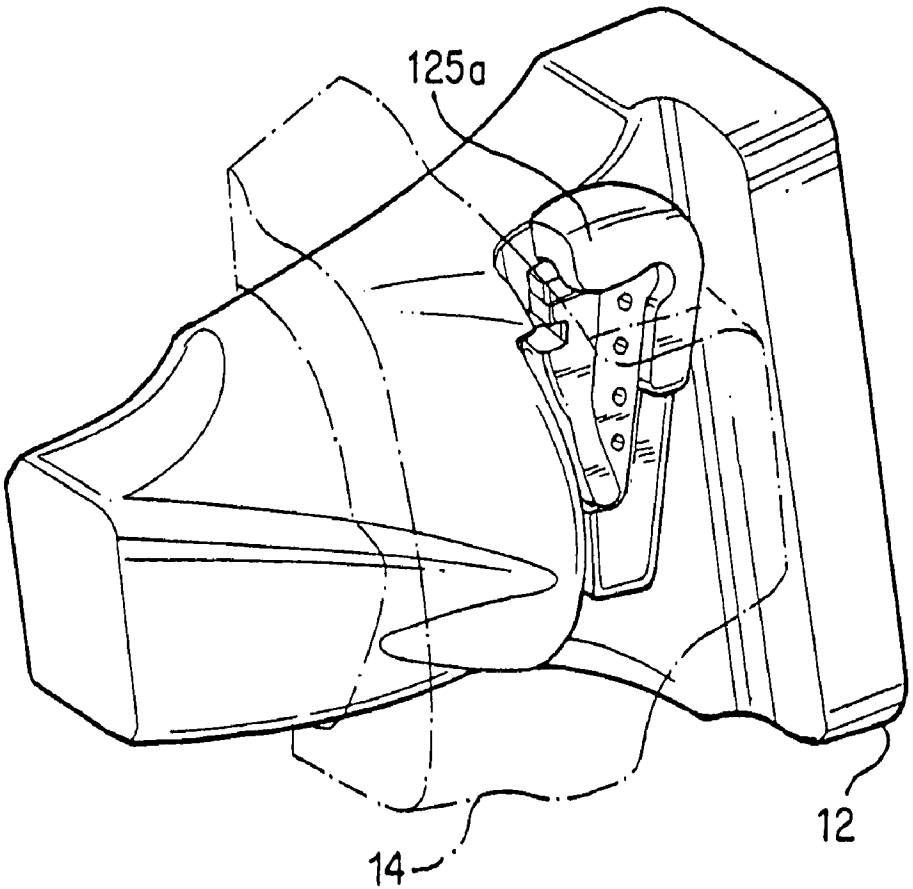
FIG. 12 is a front perspective view of another embodiment of the lock with the point shown in phantom.
Figure 13:
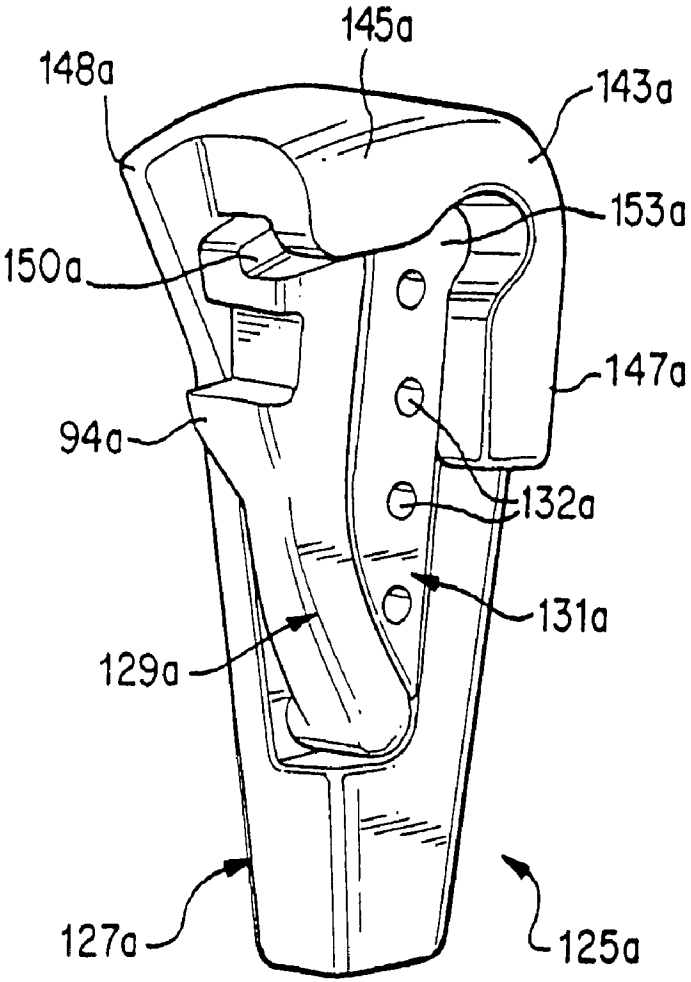
FIG. 13 is a front perspective view of the lock of FIG. 12.
Figure 14:
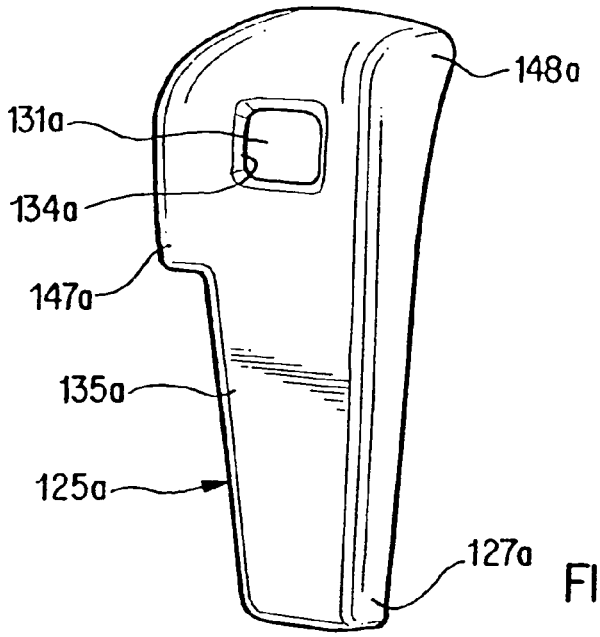
FIG. 14 is a rear perspective view of the lock of FIG. 12.

Lock 166 is inserted into slot 42 in the same manner as lock 16 (FIG. 12). The pry tool is inserted between rear wall 32 of point 14 and lock 166, and rotated rearward and downward so as to press downward on top surface 189. To remove lock 166, the free end of the pry tool engages slot 221 at the rear end of latch 170. The fulcrum of the pry tool can be either the front surface 223 of mounting end 18 of adapter 12 or the top end 44 of ear 38. Moreover, an indent 227 is provided at the front, top end of body 168 so that a second pry tool can be used to pull the lock from slot 42 if desired.

Figure 19:
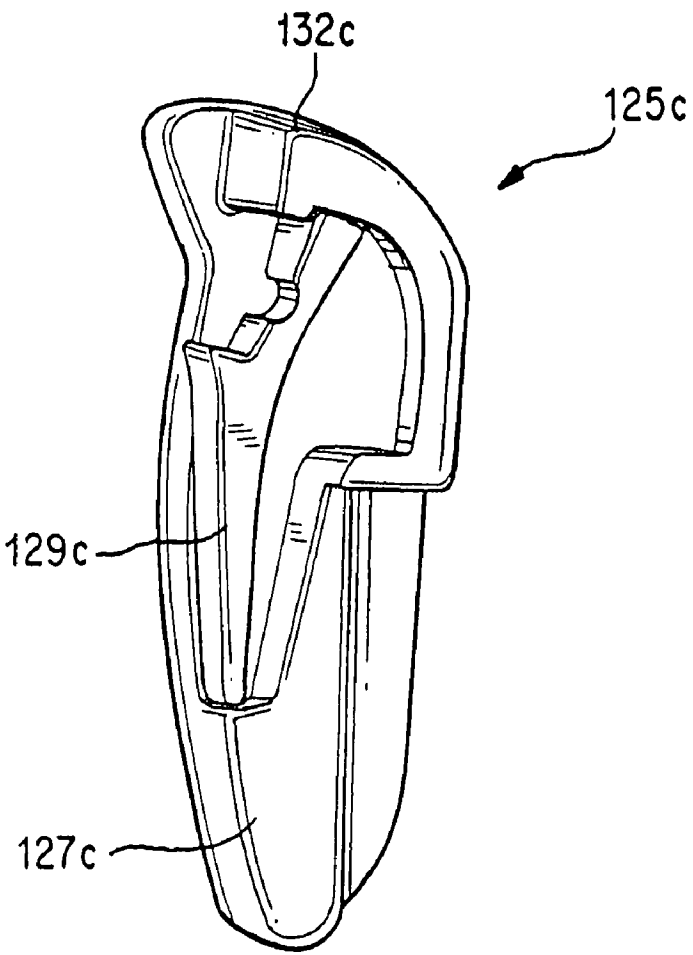
FIG. 19 is a front perspective view of the lock of FIG. 18 with the latch in an unlocked position.
Figure 20:
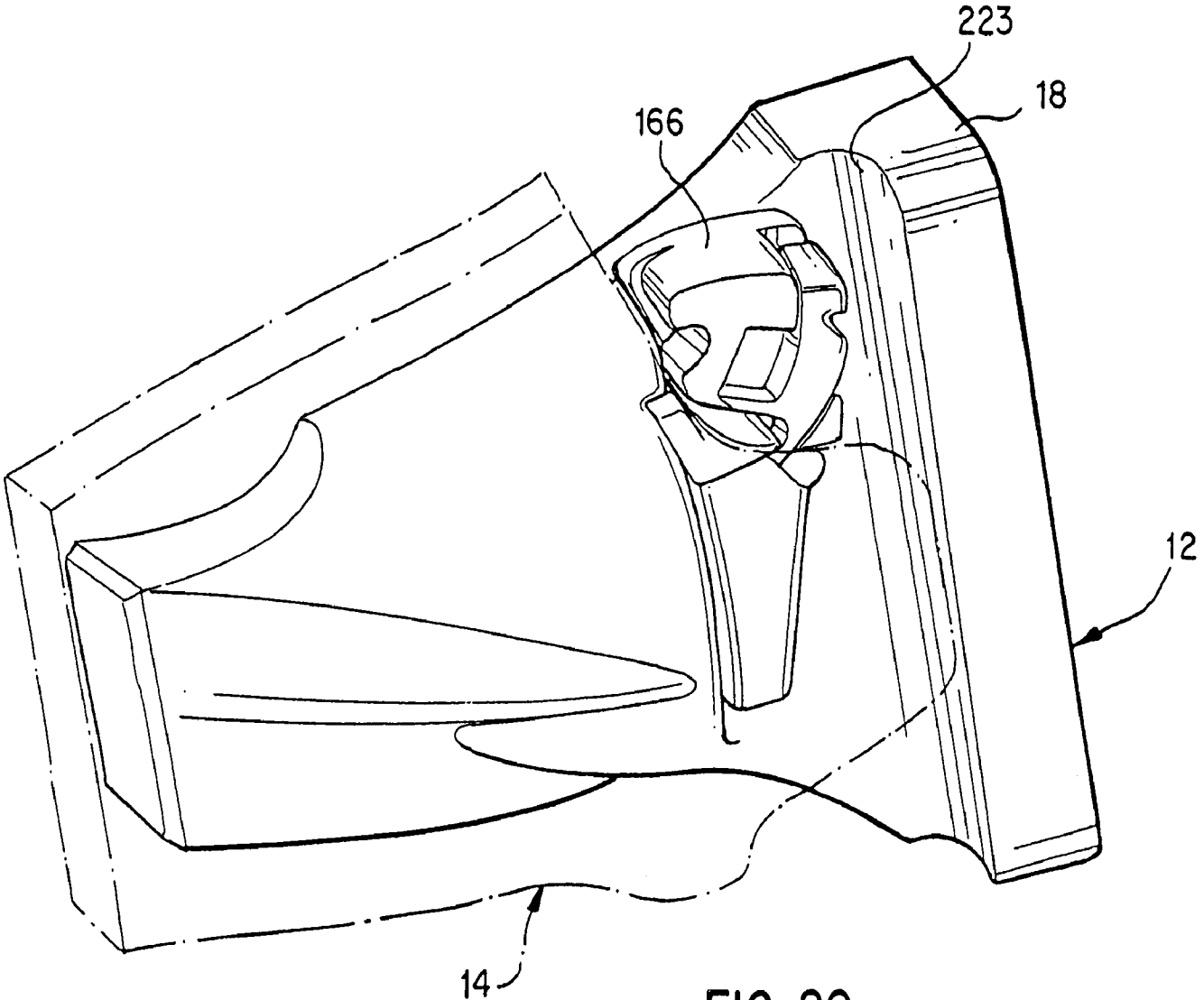
FIG. 20 is a partial perspective view of a tooth with another embodiment of the lock and with the point shown in phantom.
Figure 21:
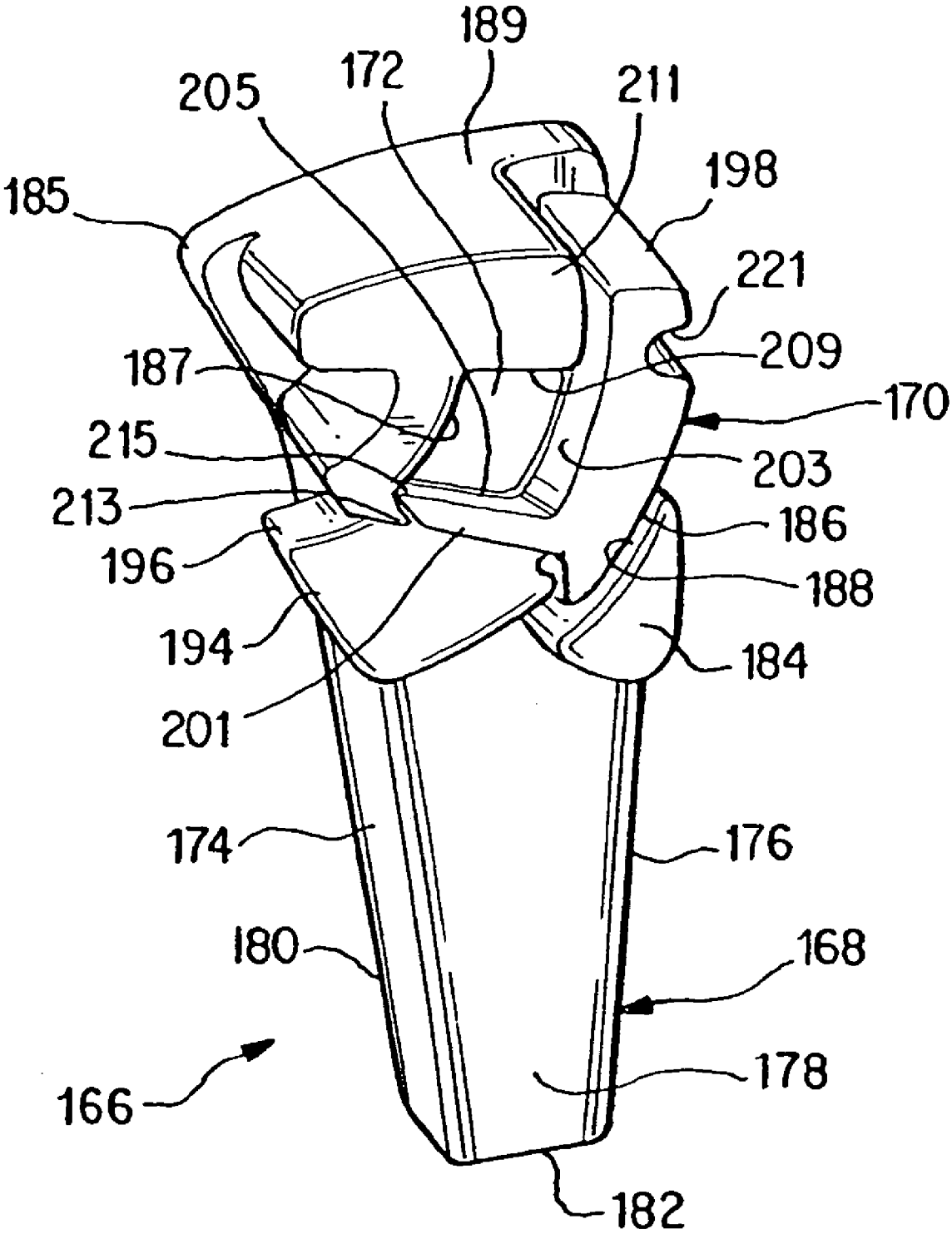
FIG. 21 is a perspective view of the lock of FIG. 20.

In another embodiment, lock 235 is inserted into slot 42 to hold point 14 to adapter 12 (FIG. 19). Lock 235 comprises a body 237, a latch 239 and a resilient member 241 (FIGS. 20-21).

Body 237 includes front and rear surfaces 243, 245, side surfaces 247, 249, and a bottom surface 251. As with the above locks, the lock body preferably tapers in three different directions—namely, the front and rear surfaces 243, 245 converge as they extend toward bottom surface 251, and the side surfaces 247, 249 converge as they extend toward the bottom surface 251 and as they extend toward front surface 243. Also, as noted above, front, rear and side surfaces 243, 245, 247, 249 can be varied in the ways as discussed above for the corresponding surfaces of lock 16. Side surface 247 includes a protrusion 250 to fit in notch 44. Front support 252 projects forward to abut rear face 32.

An upper portion of body 237 includes a recess 253. The bottom of the recess is defined as a concave, curved guide wall 255. Guide wall 255 is a circular segment that generally slopes downward toward front surface 243. Latch 239 is movably secured to body 237 by a pivot pin (not shown) that fits within hole 259. The bottom surface 261 is curved to correspond to guide wall 255 such that they slide along each other as the latch swings about pin. Shoulder 263 normally projects forwardly to engage stop 48 of point 14. Resilient member 241 is preferably an elastomer, such as neoprene or rubber, and shaped as a short curved segment that fits between a stop member 265 on body 237 and a rear pushing wall 267 of latch 239. The pushing wall 267 is defined in an indent 269 formed to receive the resilient member in recess 253. The latch preferably continually holds the resilient member under a compressive load, which holds the components together. An adhesive can be applied to hold resilient member 241 to one or both of stop member 265 and pushing wall 267, the resilient member may be molded to one of the components, or the components may be held together by mechanical means.

Figure 22:
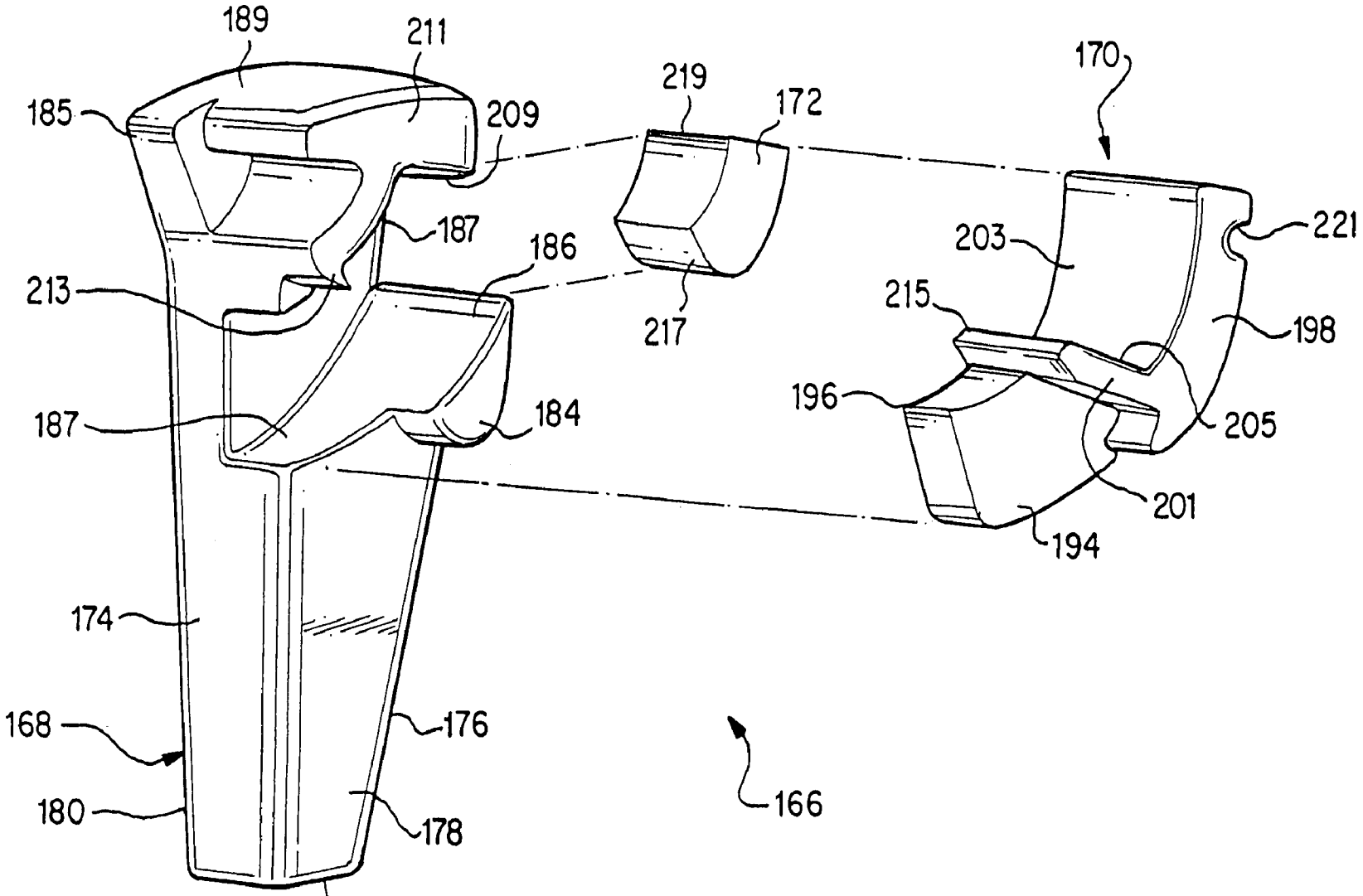
FIG. 22 is an exploded, perspective view of the lock of FIG. 20.
Figure 23:
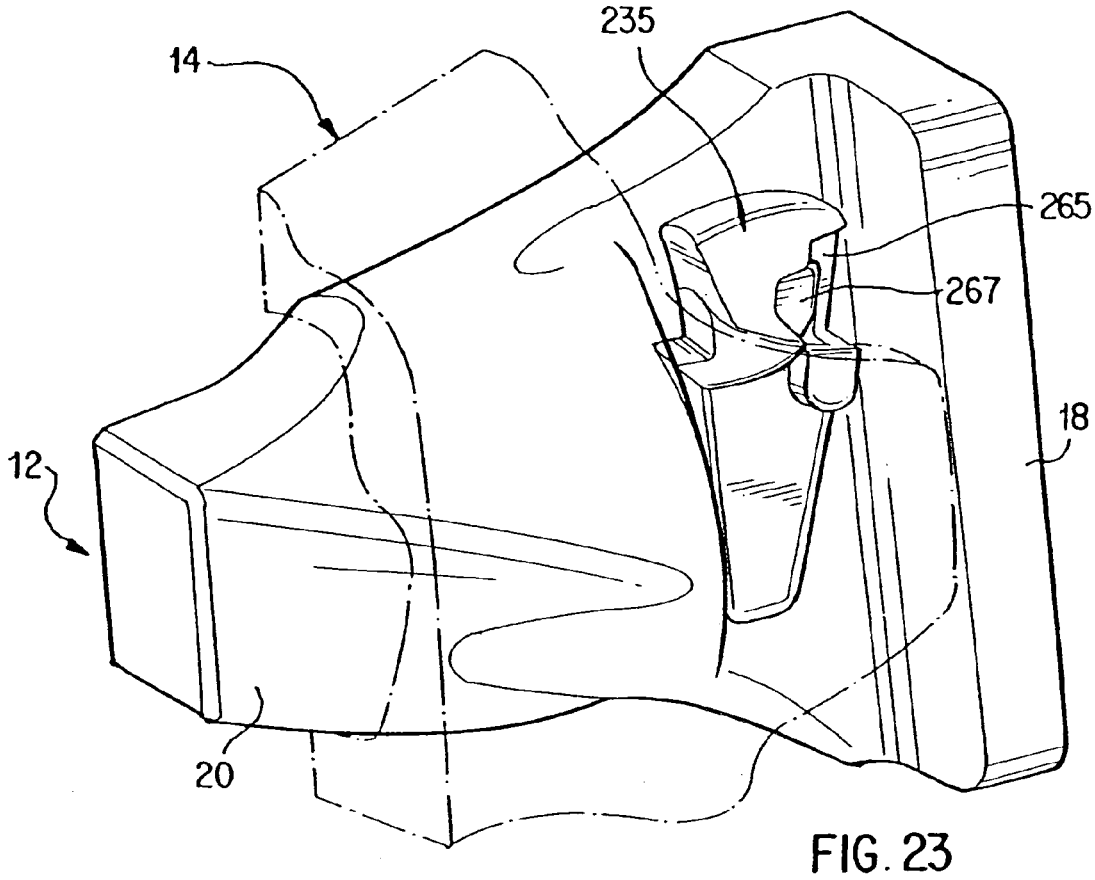
FIG. 23 is a partial perspective view of the tooth with another embodiment of the lock and with the point shown in phantom.
Figure 24:
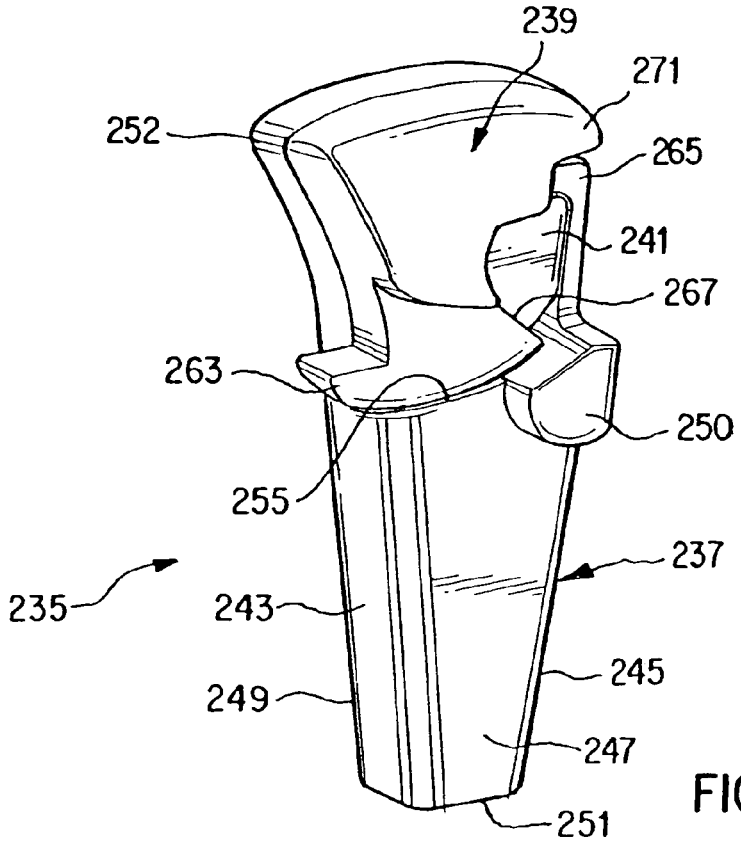
FIG. 24 is a perspective view of the lock of FIG. 23.
Figure 25:
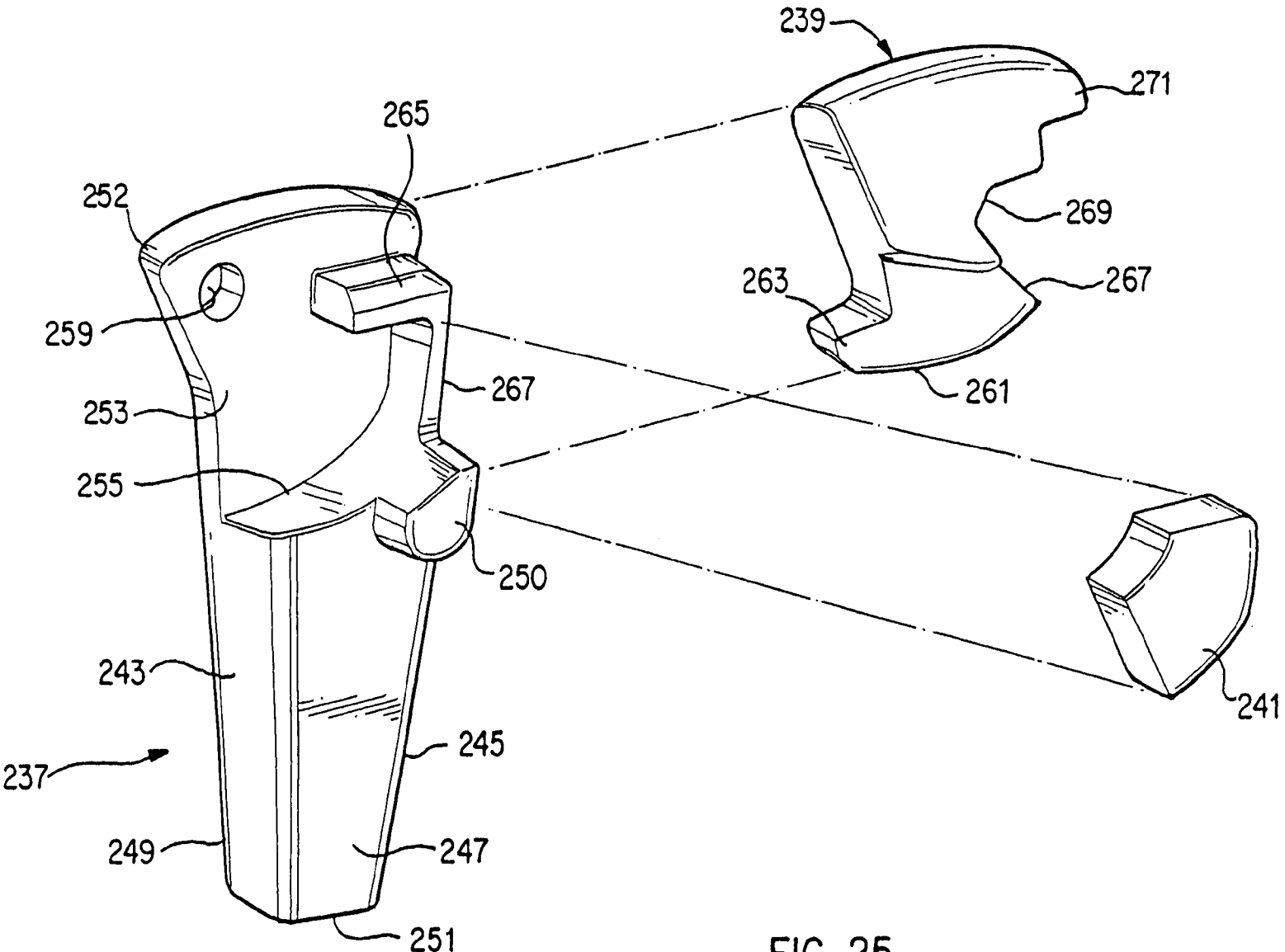
FIG. 25 is an exploded, perspective view of the lock of FIG. 23.
Figure 26:
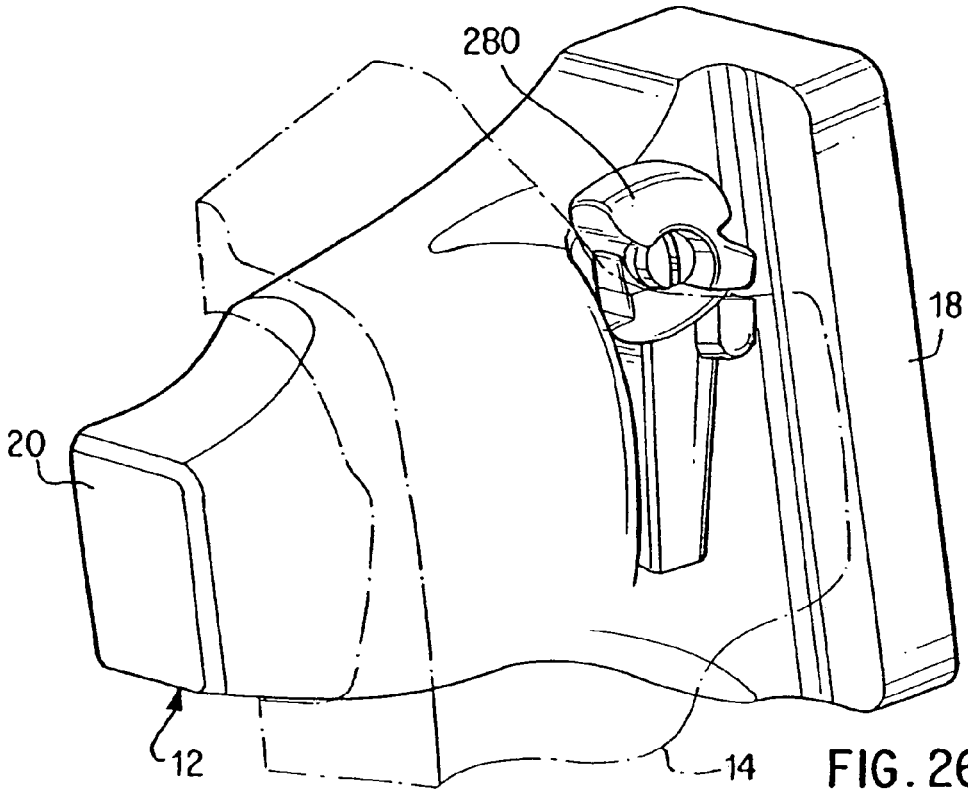
FIG. 26 is a partial perspective view of the tooth with another of the lock and with the point shown in phantom.
Figure 27:
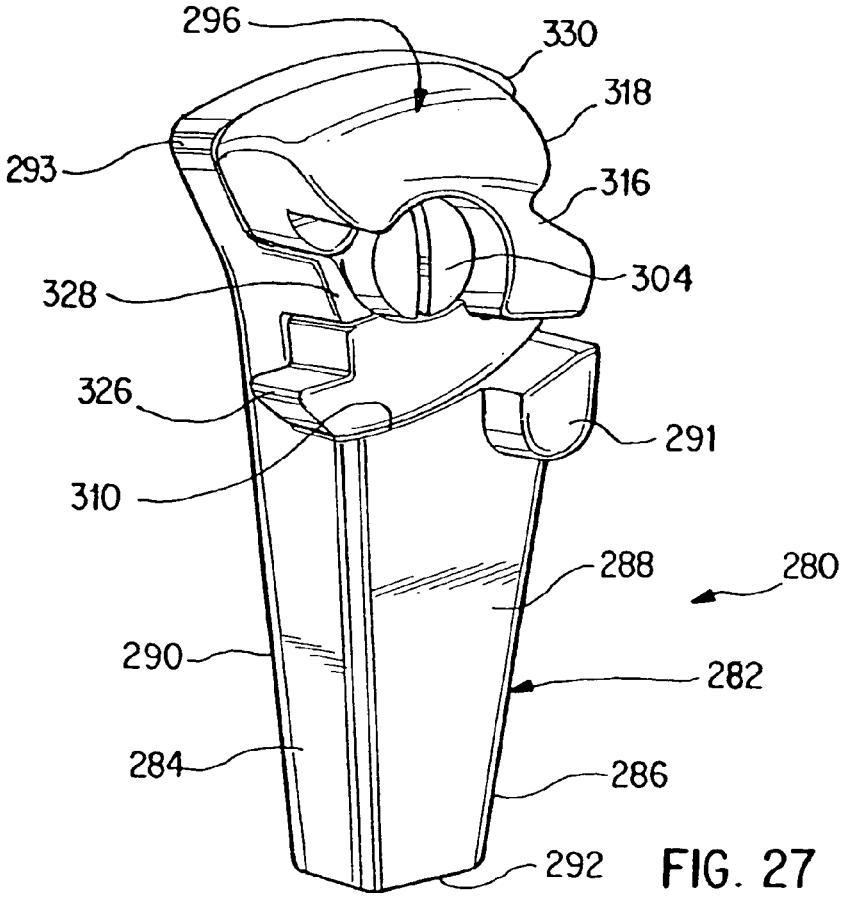
FIG. 27 is a perspective view of the lock of FIG. 26.

A finger 271 extends rearwardly from the top of the latch and over stop member 265. In this way, finger 271 abuts stop member 265 to limit the forward movement of shoulder 263. In addition, a pry tool can be inserted between the mounting end 18 of adapter 12 and lock 235 such that the free end of the pry tool engages the end of pry finger 271 (FIG. 22). The tool is then rocked rearward and downward, using the adapter as a fulcrum, to lift up on the pry finger. This lifting causes latch 239 to rotate about pivot pin 257 so as to retract shoulder 263 from engagement with stop 48. This rocking of the pry tool is continued until resilient member 241 is fully compressed and lock 235 is lifted at least partially from slot 42. Stop member 265 provides support against the rotation of latch 239 to pull lock 235 at least partially from slot 42. The lock is inserted in slot 42 in the same manner as discussed above for lock 16.

Lock 280 is also similar to lock 235 in construction (FIGS. 18-20). As with lock 235, lock 280 preferably tapers in three distinct directions and includes a body 282 having a front surface 284, a rear surface 286, and side surfaces 288, 290. The front and rear surfaces 284, 286 as well as the side surfaces 288, 290 converge as they extend toward bottom surface 292. Side surfaces 288, 290 further also preferably converge as they extend toward front surface 284. Nevertheless, the construction of body 282 may be varied in the same ways as discussed above for lock 16. A recess 294 is defined in the upper portion of the body to receive a latch 296. Like latch 239 in lock 235, latch 296 swings about a pivot pin (not shown) received in hole 302. However, unlike lock 235, lock 280 has no resilient member. Instead, a fastener 304, preferably a screw, is provided to secure the latch in its latched and unlatched conditions.

More specifically, latch 296 has a compact configuration with four rounded sides. Pivot pin 298 projects from an inner surface 306 in the upper, front corner of the latch. The bottom side 308 is curved to correspond to guide wall 310 of body 282, much like guide wall 255 of lock 235. A slot 312 extends from the front side 314 to a central portion of the latch to receive fastener 304. In this way, the fastener may simply be loosened, and not removed, to permit the latch to be manually moved between the latched and unlatched conditions. Since the top portion of the latch is exposed even when the point is on the adapter, the latch can be moved manually once the fastener is loosened. A notch 316 is provided on the rear side 318 of the latch for moving the latch between the latched and unlatched conditions, and for prying the lock from slot 42.

The central portion of latch 296 is recessed to define a clamping surface 320 against which the head 322 of fastener 304 bears when the screw is tightened into threaded bore 324. A shoulder 326 projects from the front side 314 below the open end of slot 312 to engage stop 48 when in the latched condition. Body 282 includes fore and aft stops 328, 330 for limiting the swinging of the latch. In the preferred construction, fore stop 328 is in the form of a flange that is aligned with the open end of slot 312. Bearing surface 332 abuts the lower end of the stop 328 when the latch reaches the latched condition. The fore stop further acts as a shield to inhibit fines from entering the slot and blocking the movement of the latch. The aft stop 330 is preferably formed as a bump in the upper rear corner of the boss. The rear side 318 abuts the aft stop when the latch swings to the unlatched condition where shoulder 326 disengages stop 48 of point 14. The threaded stem of fastener 304 is also preferably secured in threaded bore 324 with a lock tight coating, such as 262, from Loctite Corporation of Rocky Hill, Conn., to prevent premature loosening of the screw during use of the tooth. The fastener is preferably composed of metal, but could also be polymeric.

Figure 28:
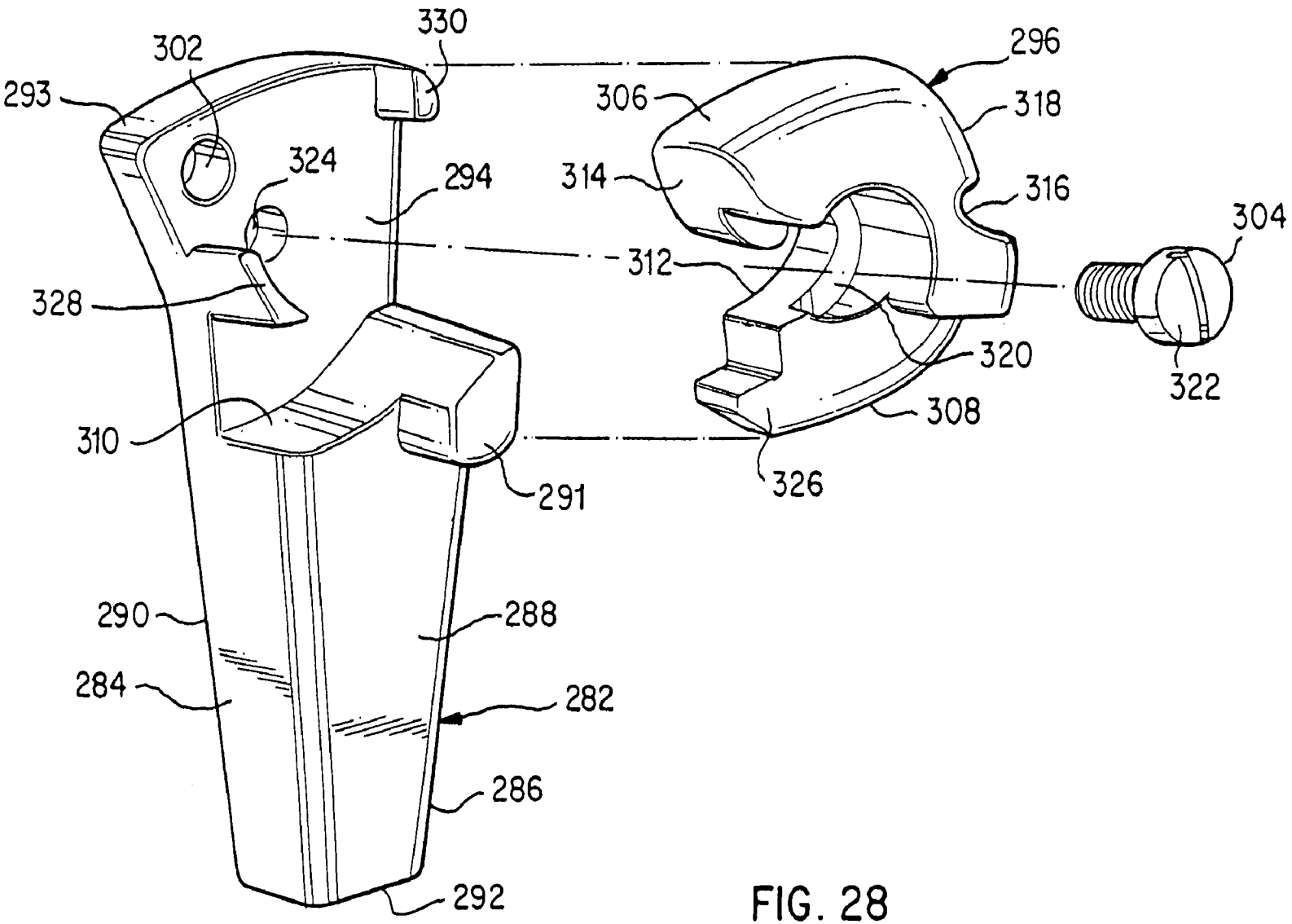
FIG. 28 is an exploded, perspective view of the lock of FIG. 26.

To insert lock 280, latch 296 is fixed by fastener 304 in the unlatched condition. Lock 280 is pried into slot 42 in the same manner as described above for lock 16. Once the lock is inserted fully in slot 42, the latch is moved to its latched condition and secured by fastener 304. The lock is removed by first loosening fastener 304. As seen in FIG. 28, the head of fastener 304 is accessible over ear 38 of point 14. Then, a pry tool is inserted vertically between the lock and the mounting end 18 of the adapter such that the free end of a pry tool is received into notch 316. The pry tool is then pushed back such that the front of mounting end 18 of the adapter acts as the fulcrum. This movement of the pry tool will swing the latch to the unlatched condition, that is, when rear side 318 abuts aft stop 330, and then lift lock 280 from slot 42. Alternatively, the pry tool may be inserted into the notch laterally and pressed down using the top of ear 38 as the fulcrum.

Figure 29:
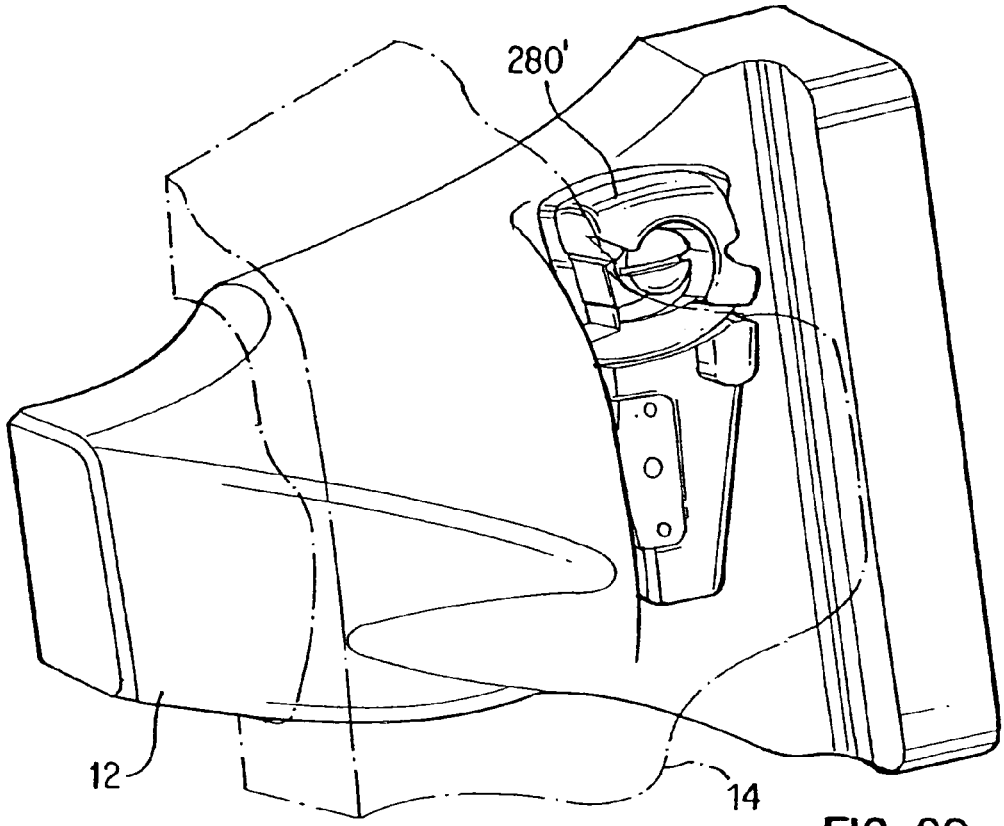
FIG. 29 is a partial perspective view of the tooth with another embodiment of the lock and with the point shown in phantom.
Figure 30:
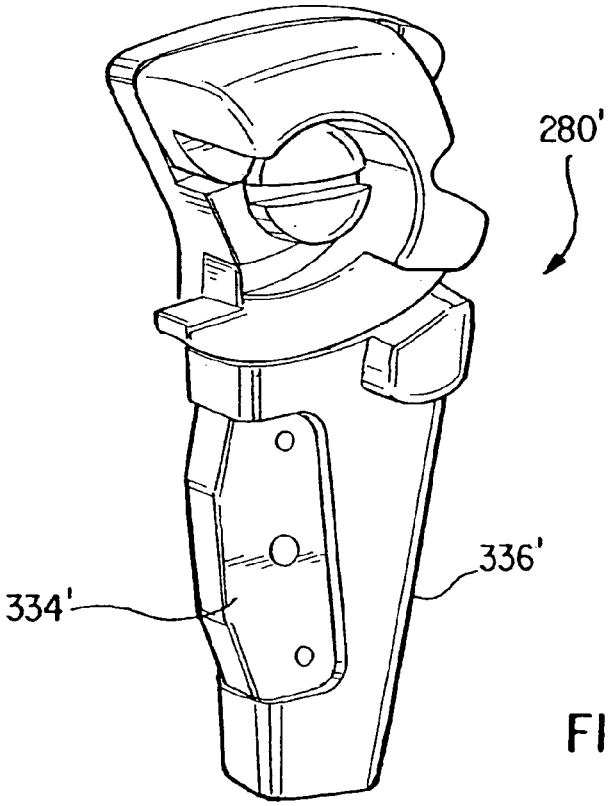
FIG. 30 is a front perspective view of the lock of FIG. 29.
Figure 31:
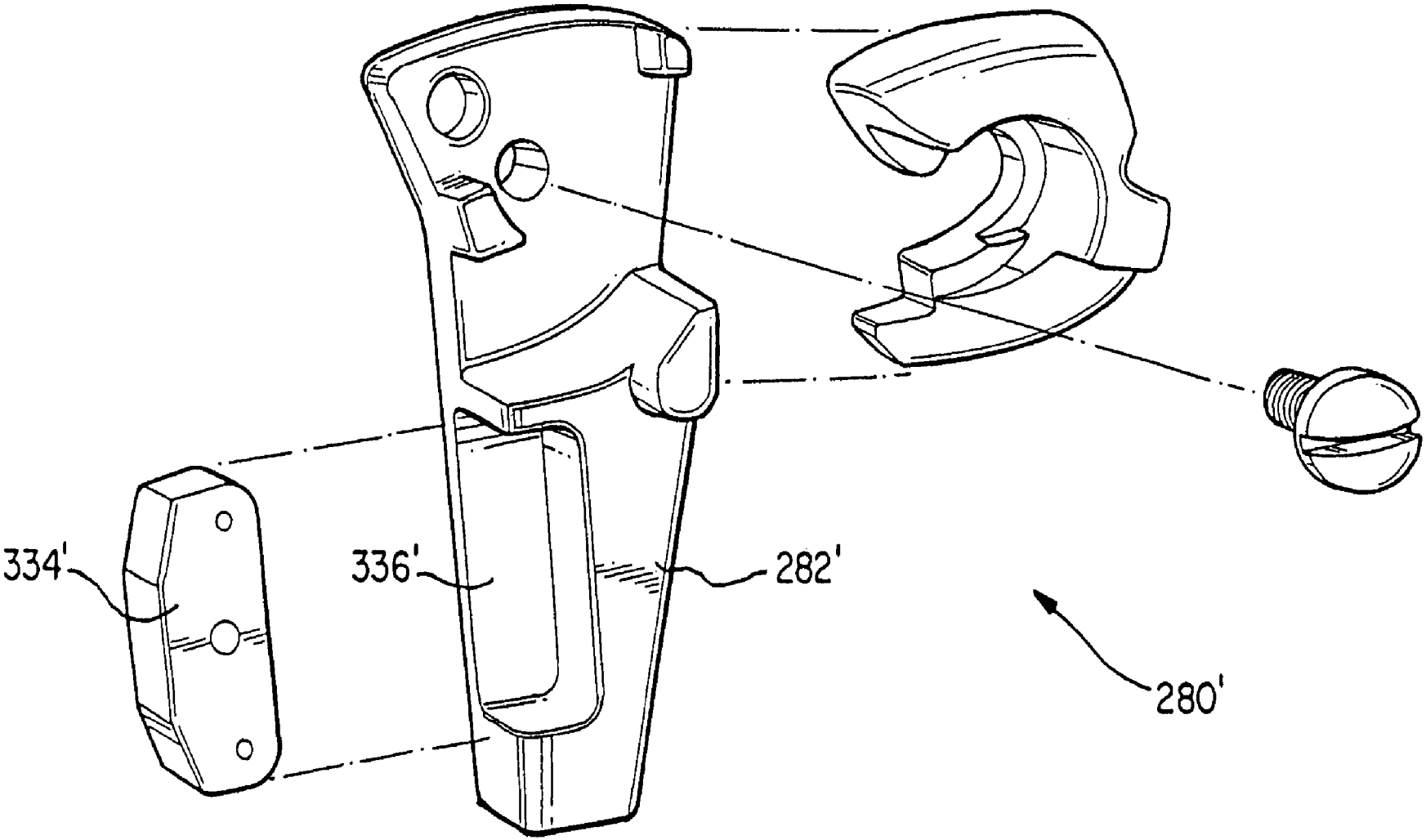
FIG. 31 is an exploded, perspective view of the lock of FIG. 29.
Figure 32:
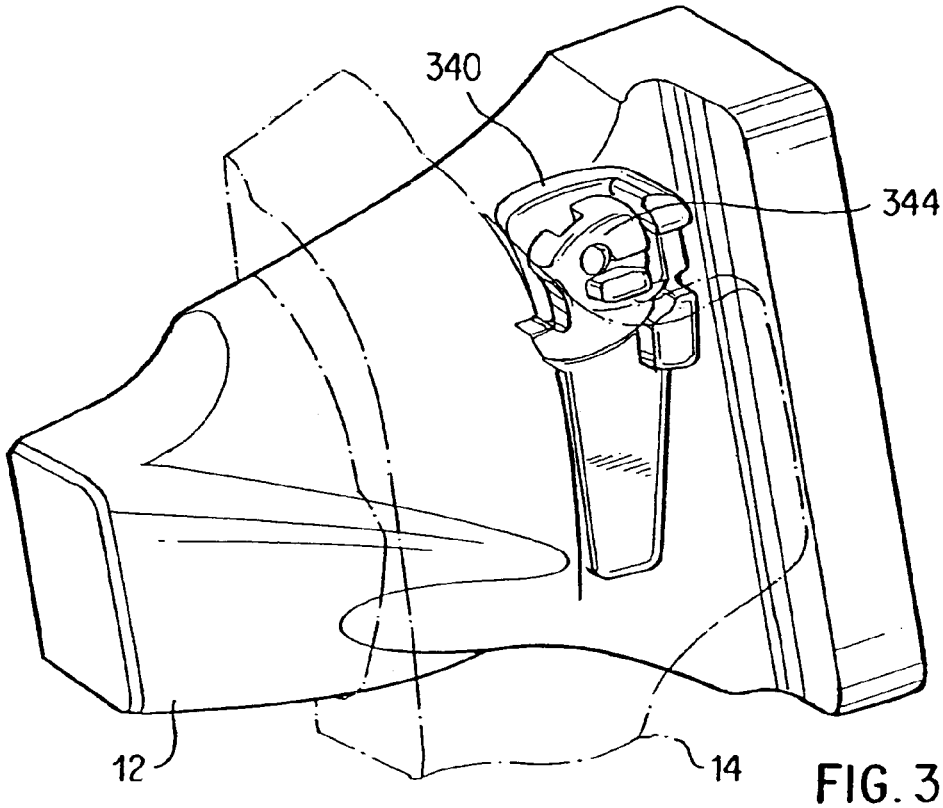
FIG. 32 is a partial perspective view of a tooth with another embodiment of the lock and with the point shown in phantom.
Figure 33:
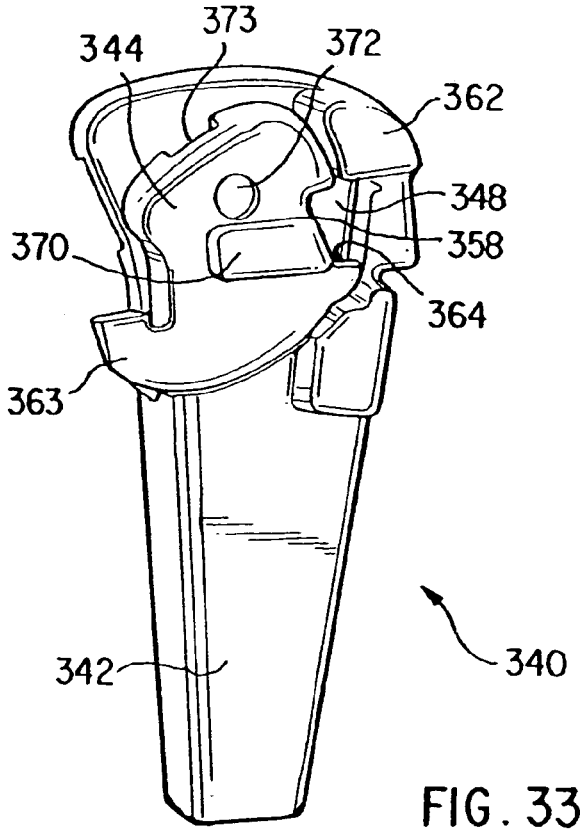
FIG. 33 is a front perspective view of the lock of FIG. 32.
Figure 34:
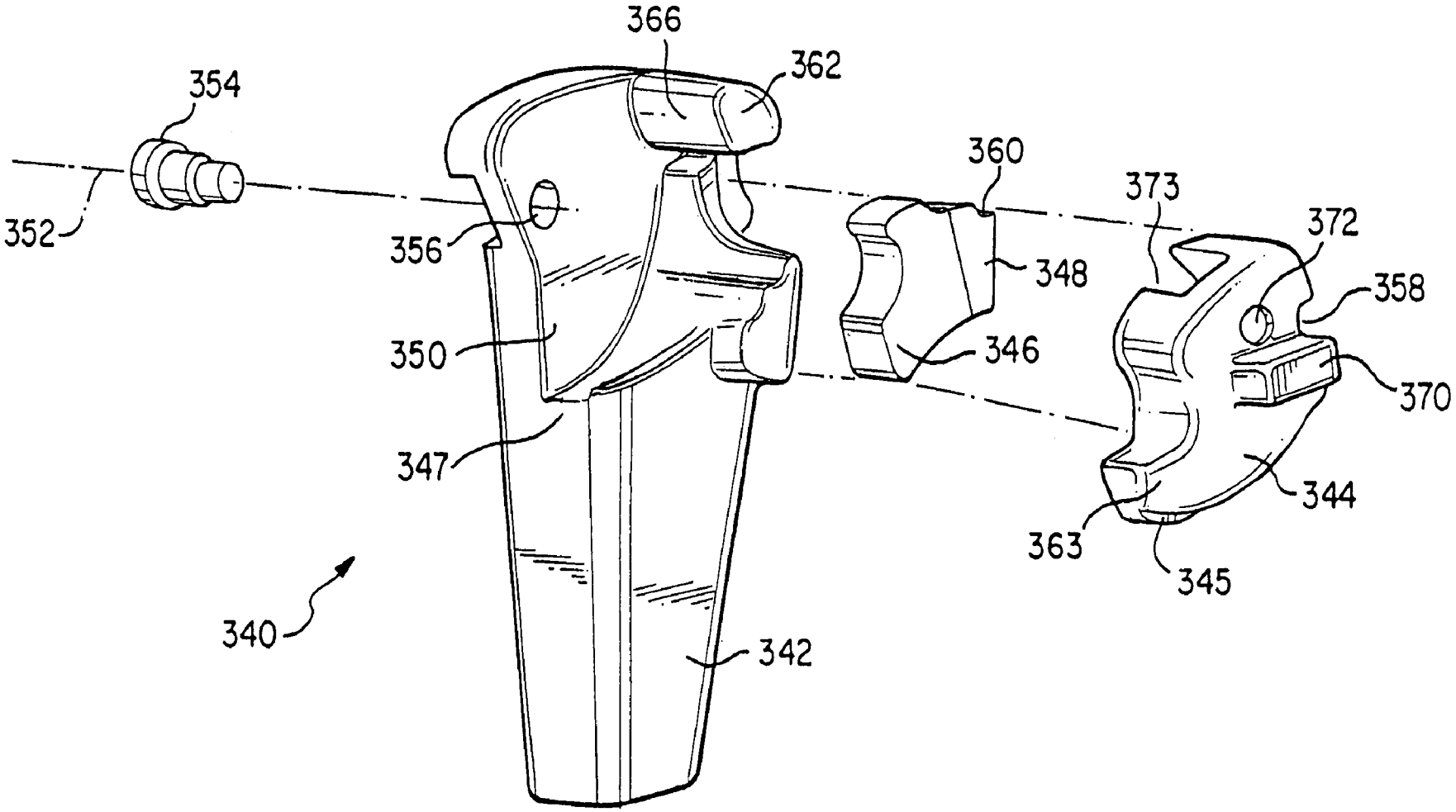
FIG. 34 is an exploded, perspective view of the lock of FIG. 32.
Figure 35:
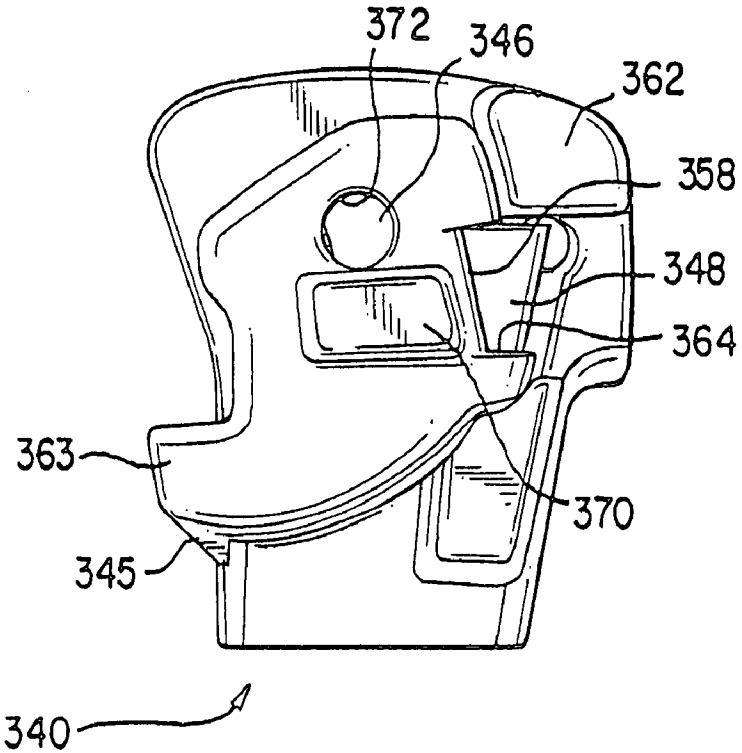
FIG. 35 is a partial side view of the lock of FIG. 32 with the latch in the latched condition.
Figure 36:
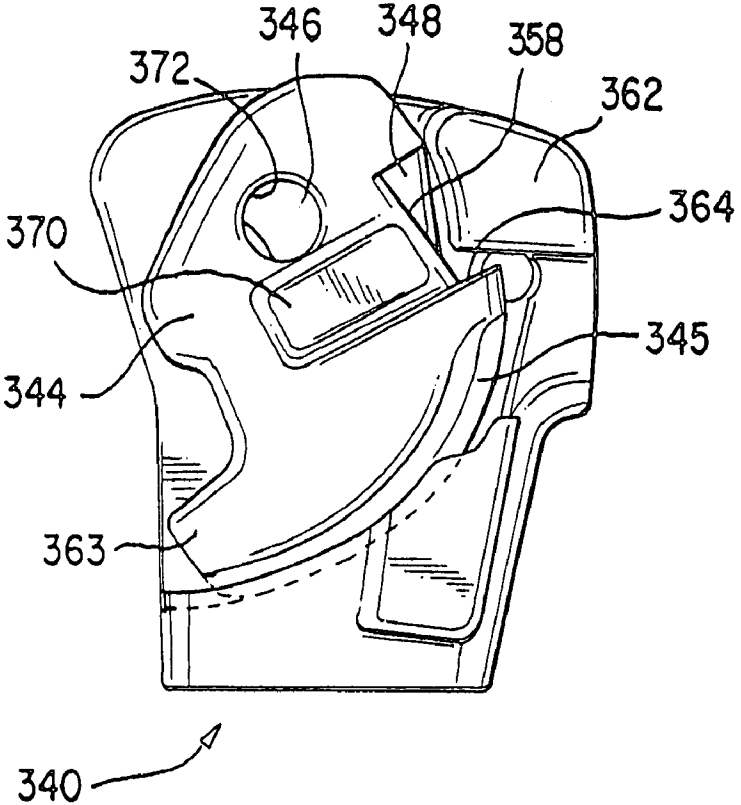
FIG. 36 is a partial side view of the lock of FIG. 32 with the latch in the unlatched condition.

As a further alternative, lock 280' can be provided with a resilient take-up member 334' in the lower portion of body 282' (FIGS. 29-31). The resilient member is preferably an elastomer composed, for example, of neoprene, rubber or the like, that is adhered or molded into an opening 336'. The take-up member can also be provided in the same way in the other disclosed locks, although the lock body for some locks (e.g., lock 125) would need to be elongated. The take-up member is provided to maintain the point and adapter in a tight fitting arrangement even after wearing occurs.

Lock 340 is another embodiment that is, in general, similar to lock 280. In particular, lock 340 includes a body-342, a latch 344, a resilient member 346 and a secondary latch 348. The body 342 defines a recess 350 for receiving latch 344 that swings about pivot axis 352. The axis is preferably defined by a fastener 354 that is received through hole 356 and is engaged with a threaded bore (not shown) in the latch. Like the latch in lock 280, latch 344 is free swinging and not biased into the latched condition by the resilient member. Rather, resilient member 346 biases the secondary latch 348 into a latched condition to secured the latch in the locked position.

More specifically, the secondary latch 348 and resilient member 346 are made as a unitary member by being molded together or alternatively being secured by adhesive or other means. The resilient member 346 is configured to fit and be confined with a hollow portion (not shown) in latch 344. The secondary latch is normally biased rearward into an opening 358 defined in a rear portion of latch 344. The secondary latch includes a shoulder 360 that is adapted to engage a projection 362 formed on body 342. In this position, the secondary latch 348 overlies the lower edge 364 of opening 358 such that the lower edge abuts the secondary latch if the latch begins to turn from the latched toward the unlatched condition. The shoulder 360, then, abuts projection 362 and prevents movement of the latch to the unlocked condition.

To remove the lock, a pry tool is inserted into the opening 358 to push the secondary latch 348 forward and inside of latch 344 so that it releases projection 362. With the secondary latch pushed inward, the pry tool is used to turn the latch counter-clockwise such that the secondary latch abuts the front face 366 of projection 362. The operator continues to turn the latch until the finger 368 releases stop 48 of point 14. The latch preferably includes a protrusion 370 on the front end to aid in turning the latch if needed. Expansion ports 372, 373 are also preferably provided to accommodate the expansion of resilient member 346 as the secondary latch is pushed forward.

Figure 38:
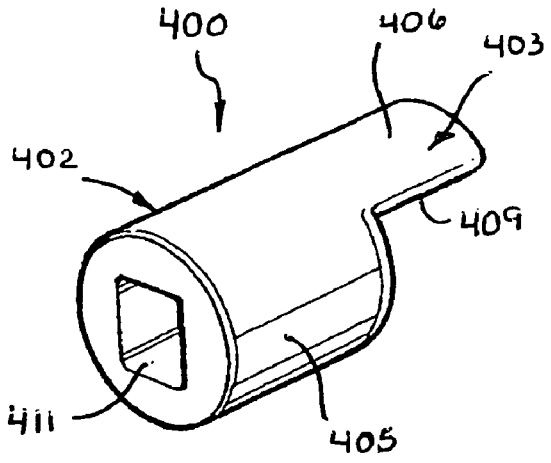
FIG. 38 is a rear perspective view of the pry tool.
Figure 37:
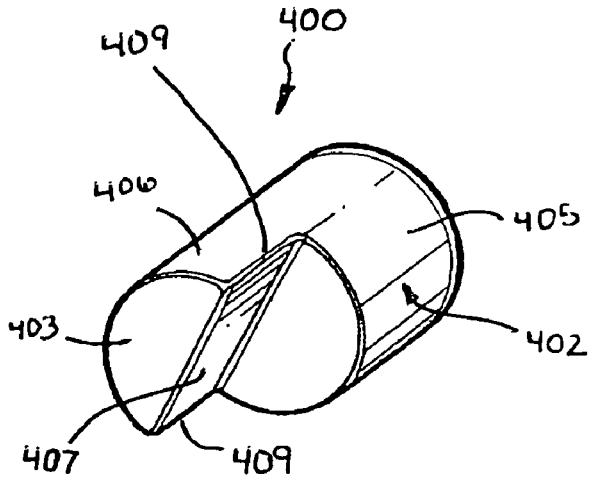
FIG. 37 is a front perspective view of a pry tool.

A rotatable pry tool 400 can be used to release the latch and pull the lock upward from the slot. As seen in FIGS. 37-38, the pry tool preferably has a generally rounded configuration, with a cylindrical body 402 and a distal or prying projection 403 on a front end of the body. In the preferred construction, the prying projection has a cylindrical wall portion 406 that is an extension of the cylindrical wall 405 of body 402. The cylindrical wall portion 406 preferably extends about 180 degrees about the tool (although other extensions are possible), and a flat 407 extends diametrically across the tool to form the prying projection 403. The flat 407 forms two rounded corners with the cylindrical wall portion to form pry structures 409 that are used to release the latch of the lock and/or pull the lock from the opening. Nevertheless, the pry structure and the pry projection could each have different constructions. For example, the pry structure could extend entirely or partially outside of the bounds of peripheral wall 405, the cylindrical wall portion could be independent of the body (and not as an extension of wall 405) or have a non-cylindrical shape, or the flat could be non-planar, so long as the pry structure performs the desired prying when the tool is rotated.

The rear end of the body includes a formation to attach to a driver for rotating the tool. The formation is preferably a socket 411 with flats (e.g., a square socket) that is adapted to engage a driving tool (powered or manual) for facilitating rotation of the tool. In this embodiment, the pry tool 400 is adapted to fit on the end of a shank of a torque wrench or the like. As an alternative, the pry tool 400 for removing the lock can be formed as part of a single assembly with a pry tool T for inserting the lock. For instance, a shank having a dogleg bend could be used to connect the two pry tools for manual operation.

Figure 39:
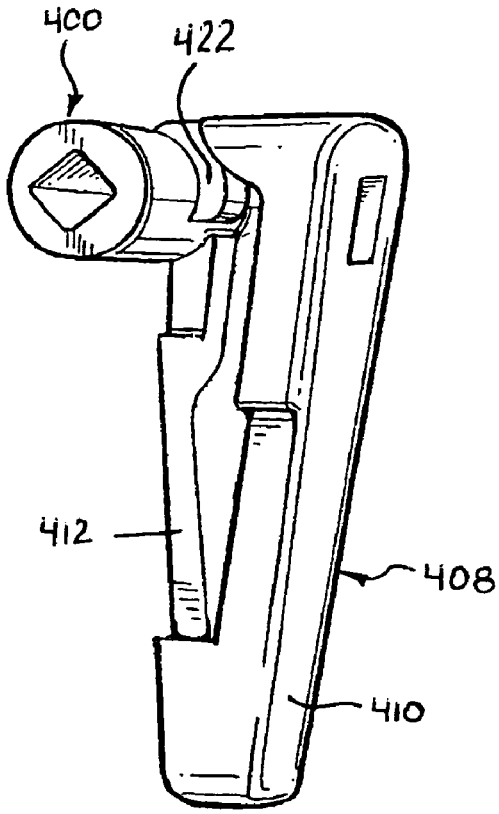
FIG. 39 is a side perspective view of another embodiment of a lock in accordance with the present invention with the pry tool.
Figure 41:
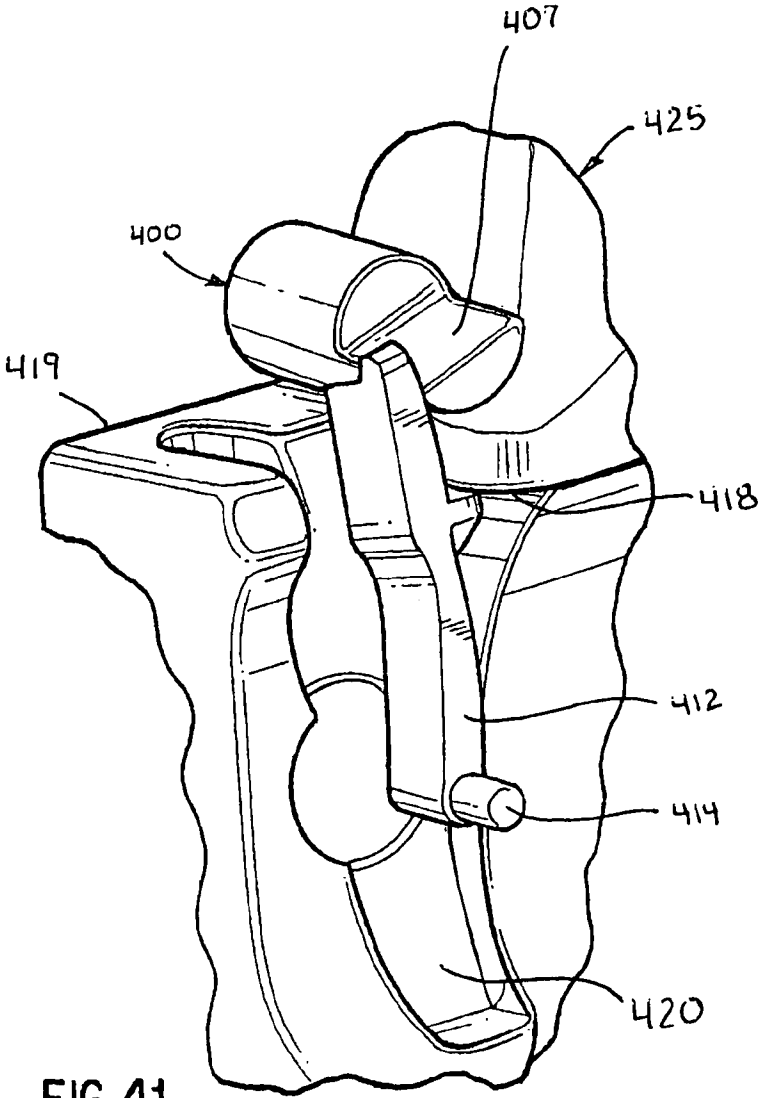
FIG. 41 is the same view as FIG. 38 except that the tool has been rotated to move the latch to the release position.
Figure 40:
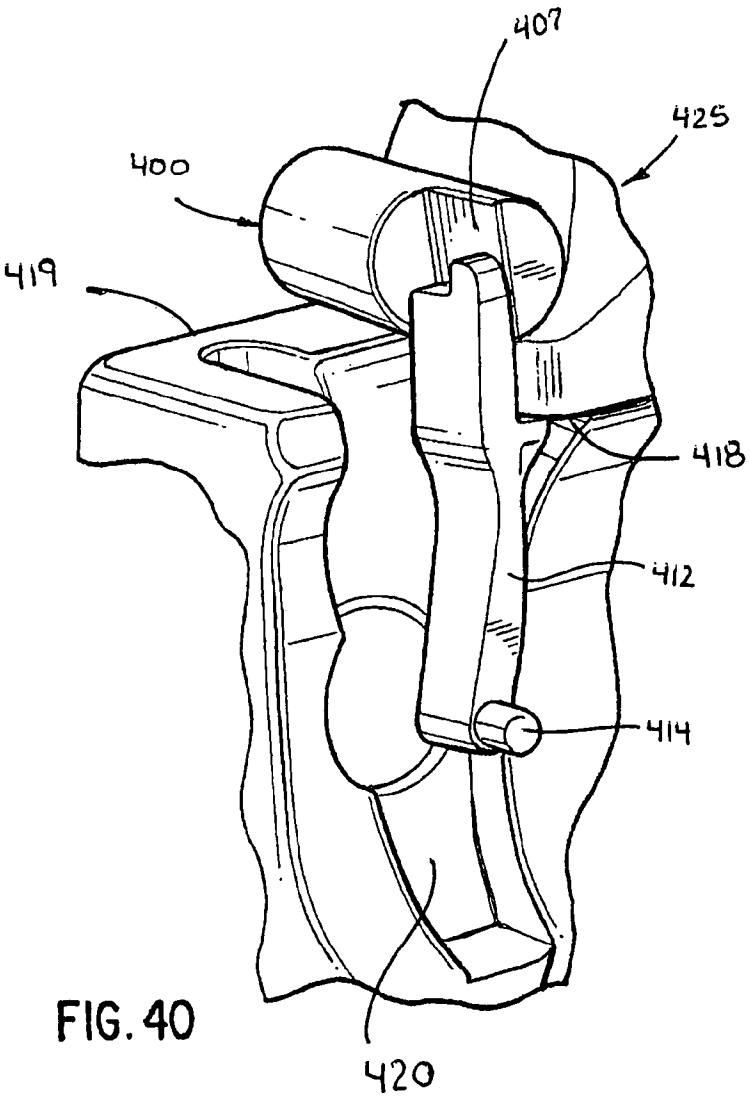
FIG. 40 is a partial perspective view of the wear assembly with the nose and all but the latch of the lock omitted, and with the pry tool in place for operation.

In use, pry tool 400 is preferably used in conjunction with a tapered lock having a body and a latch. As an example, the tool is shown in FIGS. 39-41 operating with a lock 408, although any of the other locks disclosed herein could be used with some modification consistent with the formations of lock 408 that cooperate with the pry tool. Lock 408 includes a body 410 and a pivotally attached latch 412 that swings about a pivot pin 414. To remove the lock with pry tool 400, the tool is first set along the top of ear 419 of a point 425 with the flat 407 opposite the front of the latch (i.e., generally in rounded corner or intersection 426). In the preferred construction, the cylindrical wall portion 406 and/or cylindrical wall 405 of the tool corresponds generally to the curved shape typically defined along the intersection of the ear and body of the point. Nevertheless, either the intersection 426 or the tool 400 could be shaped differently so long as the point (or other wear member) provides sufficient support for the prying action of the tool.

Tool 400 is then rotated (clockwise as shown in FIG. 40) so that one of the pry structures 409 engages and moves the latch 412 to the release position, i.e., disengaged with the stop 418 in the tapered opening 420. As the tool continues to rotate past the position in FIG. 41, the prying structure presses on an abutment 422 on the lock to pull the lock from the opening. While the abutment 422 is preferably provided on the body, it could be provided on the latch. As can be appreciated, the tool only partially pulls the lock from the opening, however, once movement is made and the fixing of the lock with "cemented" fines is broken the lock can be easily removed from the opening. A reference to pulling the lock from the opening herein is considered to include such partial pulling of the lock from the opening. Once the lock is freed by the prying action of the tool, the lock is removed from the opening 420 so that the wear member 425 can then be removed from the adapter nose. If the adapter is stuck onto the nose because of "cemented" fines or other reasons, the pry tool 400 can be positioned between the rear of the ear and the adapter and rotated to free the wear member for easy removal. Similarly, the tool may also be used to remove a wear cap or other wear member from the wear assembly.

FIG. 42 illustrates wear member 425 in the form of a point that includes a body 427 and an ear 419. A lock (not shown) in accordance with the present invention is placed in the opening 420 defined in the ear. A pry tab 433 preferably extends from an upper portion of the point to provide a stable anchor for a pry tool T (shown in FIG. 1). For instance, the tool is placed generally laterally into the assembly with the free end F of the tool placed against the lower surface 435 of tab 433 and the shank S of the tool against the top of the lock. Downward pressure on the handle portion of the tool T then pries the lock fully into the opening. Although the tab is shown in conjunction with wear member 425, this and other tabs can be provided at various locations on the wear members disclosed herein or usable with other wear members including the inventive aspects of the present invention to provide an anchor for the pry tool for inserting (or removing) the lock.

FIG. 43 illustrates a modified adapter configuration that can be used in cooperation with a tapered lock in accordance with the present invention. As an example, the adapter is shown in use with lock 125*c*. The nose 440 of the adapter 442 includes a depression 444 in a side for receiving the lock and parts of the ear of the point. The adapter further includes a ledge 446 that forms an anchor for a pry tool T to insert the lock into the opening defined between the ear and the nose of the adapter. As can be appreciated, the lock is first partially inserted into the opening. The pry tool T is set with its free end F against the lower surface 448 of the ledge 446 and the shank S against the top of the lock. The handle portion of the tool (not shown) is then pressed downward to press the lock into the opening until the latch locks with the stop of the opening. Although the ledge is only shown with adapter 442, this and other ledges or the like could be provided on the other adapters disclosed herein or on other support structures usable with the inventive aspects of the present invention to provide an anchor for the pry tool to insert (or remove) the lock from the opening.

As noted earlier, the aspects of the present invention are usable with wear members other than tooth points. For instance, the wear member may be a shroud similar to that disclosed in U.S. Pat. No. 5,088,214 (hereby incorporated by reference) or an adapter similar to that disclosed in U.S. Pat. No. 5,653,048 (hereby incorporated by reference). In either case, the lock and opening could be formed with the aspects as taught above for the point. The lock could be inserted into the opening from the top of the wear member (such as disclosed in the noted '214 and '048 patents) or laterally from a side of the wear member. Further, in this type of assembly, the support structure secured to the excavating equipment would be a boss as opposed to an adapter, and the support cavity receiving the support structure would be a slot in the wear member instead of a socket. Other such assembled support structures and wear members can also be formed to utilize the advantageous aspects of the present invention.

The invention claimed is:

1. A wear member for use in excavating comprising:

a body having a front end, a rear end, a top wall, a bottom wall, side walls interconnecting the top and bottom walls, and a rearwardly opening socket for receiving a nose which is fixed to excavating equipment, wherein the top and bottom walls converge toward front end, and the socket is defined by interior surfaces of the upper, lower and side walls; and at least one ear extending from one of the side walls rearward of the body, the ear having a tapered slot with an inlet end for receiving a lock by which the wear member is retained to the nose, wherein the slot tapers away from the inlet end.

2. A wear member in accordance with claim 1 in which the slot includes a front wall surface and a rear wall surface which converge in a direction away from the inlet end.

3. A wear member in accordance with claim 2 in which the front and rear wall surface converge along substantially their entire lengths.

4. A wear member in accordance with claim 2 where the front wall surface is non-linear and the rear wall surface is generally linear.

5. A wear member in accordance with claim 2 in which the slot is defined by the front wall surface, rear wall surface and a side surface that extends between the front and rear wall surfaces, wherein the side surface converges toward a central vertical plane of the socket as the side surface extends away from the inlet end.

6. A wear member in accordance with claim 5 in which the side surface extends away from the central vertical plane of the socket as the side surface extends rearward.

7. A wear member in accordance with claim 1 in which the slot further includes a notch in the side surface adjacent the rear wall surface and the inlet end for receipt of protrusion of the lock.

8. A wear member in accordance with claim 1 wherein the slot tapers in two generally perpendicular directions.

9. A wear member in accordance with claim 1 wherein the slot tapers in three generally perpendicular directions.

10. A wear member in accordance with claim 1 wherein the slot is defined by a front wall surface, an opposing rear wall surface, and a side surface extending between the front and rear wall surfaces, and wherein the side surface converges toward a central vertical plane of the socket as the side surface extends away from the inlet end.

11. A wear member in accordance with claim 10 wherein the side surface converges toward the central vertical plane over substantially the entire length of the side surface.

12. A wear member in accordance with claim 1 wherein the slot is defined by a front wall surface, an opposing rear wall surface, and a side surface extending between the front and rear wall surfaces, and wherein the side surface converges toward a central vertical plane of the socket as the side surface extends toward the font wall surface.

13. A wear member in accordance with claim 12 wherein the side surface converges toward the central vertical plane over substantially the entire distance between the rear wall surface and the front wall surface.

14. A wear member in accordance with claim 1 in which the slot includes a stop for releaseably retaining the lock in the slot.

15. A wear member in accordance with claim 14 in which the stop projects into the slot from the front wall surface.

16. A wear member in accordance with claim 1 in which the slot includes a notch in at least one wall surface.

17. A wear member in accordance with claim 1 wherein the wear member is a point of an excavating tooth.

18. A wear member for use in excavating comprising: a wear surface;

a support cavity for recieving a support structure secured to excavating equipment; and an opening by an interior wall having a front wall surface and a rear wall surface, the opening having an inlet end for receving a lock to retain the wear member to the support structure and a stop formed along the front wall surface for releasbly retaining the lock in the opening and the opening norrowing along at least part of the length of the the opening as the opening extends away from the inlet end and the stop.

19. A wear member in accordance with claim 18 wherein the stop is a projection that projects into the opening from the front wall surface.

20. A wear member in accordance with claim 18, wherein the front and rear wall surfaces gradually converge as they extend away from the inlet end.

21. A wear member in accordance with claim 20 in which the opening has a width extending generally transverse to the front and rear wall surfaces, wherein the width gradually narrows as the opening extends away from the inlet end.

22. A wear member in accordance with claim 21 wherein the opening gradually widens as the opening extends from the front wall surface to the rear wall surface.

23. A wear member in accordance with claim 22 further including a rearwardly extending ear, wherein the opening is formed in the ear.

24. A wear member in accordance with claim 18 in which the opening has and a width extending generally transverse to the front and rear wall surfaces, wherein the width gradually narrows as the opening extends away from the inlet end.

25. A wear member in accordance with claim 18 wherein the opening includes a front wall surface and a rear wall surface, and the opening gradually widens as the opening extends from the front wall surface to the rear wall surface.

26. A wear member in accordance with claim 18 which is a point of an excavating tooth, wherein the support cavity is a socket adapted to receive a support structure in the form of a nose of an adapter.

27. A wear member in accordance with claim 18 wherein the rear wall surface is generally linear to engage a complementary rear wall of the lock.

28. A wear member for use in excavating comprising:

a wear surface;

a support cavity adapted to receive a support structure secured to excavating equipment, the support cavity having a rearwardly extending longitudinal axis; and an opening for receiving a lock to hold the wear member to the support structure, the opening having an open inlet end by which the lock is received, a forward end, a rearward end, a length generally in the direction the lock is inserted into the opening, a thickness generally in the direction of the longitudinal axis of the support cavity, and a width generally perpendicular to the length and the thickness, wherein the opening tapers in both the width and the thickness as the opening extends away from the inlet end.

29. A wear member in accordance with claim 28 wherein the opening widens as the opening extends from the forward end to the rearward end.

30. A wear member in accordance with claim 29 wherein the opening includes a stop to releasably retain the lock in the opening.

31. A wear member in accordance with claim 30 further including a rearwardly extending ear, wherein the ear includes the opening for the lock.

32. A wear member in accordance with claim 28 wherein the thickness and the width each tapers along substantially the entire length of the opening.

33. A wear member for use in excavating comprising:

a wear surface;

a rearwardly opening socket for receiving a nose fixed to excavating equipment, the socket having interior upper, lower and side surfaces, and a rearwardly extending longitudinal axis; and an opening for receiving a lock, the opening being laterally offset from the longitudinal axis and having an inlet end for receiving a lock in a direction generally transverse to the longitudinal axis to hold the wear member to the nose, the opening tapering in a direction away from the inlet end.

34. A wear member in accordance with claim 33 wherein the opening tapers along two perpendicular axes in a direction away from the inlet end.

35. A wear member in accordance with claim 33 wherein the opening includes a stop for cooperating with a latch on the lock to retain the lock within the opening.

36. A wear member in accordance with claim 33 wherein the opening includes a lateral notch adjacent the inlet end for receiving a protrusion on the lock.

37. A wear member in accordance with claim 33 which further includes a rearwardly extending ear, wherein the opening is defined in the ear and includes a front wall and a rear wall that converge toward each other in a direction away from the inlet end.

* * * * *

UNITED STATES PATENT AND TRADEMARK OFFICE

CERTIFICATE OF CORRECTION

PATENT NO. : 7,367,144 B2
APPLICATION NO. : 11/324944
DATED : May 6, 2008
INVENTOR(S) : Larren F. Jones et al.

It is certified that error appears in the above-identified patent and that said Letters Patent is hereby corrected as shown below:

In Column 18, line 62, “an opening by” should be changed to --an opening defined by--.

In Column 18, line 67, “norrowing” should be changed to --narrowing--.

In Column 19, line 1, “the the” should be changed to --the--.

In Column 19, line 20, “and” and “a” should both be deleted.

Signed and Sealed this

Tenth Day of November, 2009

David J. Kappos

David J. Kappos
*Director of the United States Patent and Trademark Office*